United States Patent [19]

Morris

[11] 4,329,964

[45] May 18, 1982

[54] LIQUID FUEL CARBURETION SYSTEM

[76] Inventor: George Q. Morris, 655 Paseo Esmeralda, Newbury Park, Calif. 91320

[21] Appl. No.: 210,187

[22] Filed: Nov. 25, 1980

Related U.S. Application Data

[63] Continuation-in-part of Ser. No. 888,045, Mar. 17, 1978, abandoned.

[51] Int. Cl.[3] ..... F02M 31/00

[52] U.S. Cl. ..... 123/557; 261/41 D; 261/144

[58] Field of Search ..... 123/545, 546, 557; 261/144, 145, 142, DIG. 68, 41 D

[56] References Cited

U.S. PATENT DOCUMENTS

| | | | |
|---|---|---|---|
| 1,732,531 | 10/1929 | Plaut | 261/41 D |
| 1,962,010 | 9/1977 | Newbury | 261/41 D |
| 2,658,734 | 11/1953 | Henning | 261/41 D |
| 2,793,633 | 5/1957 | Hestler | 261/41 D |
| 2,918,046 | 12/1959 | Teagarden | 261/DIG. 68 |
| 3,139,874 | 7/1964 | Krein | 261/145 |
| 3,215,417 | 11/1965 | Whitemore | 261/142 |
| 3,453,994 | 7/1969 | Nutten | 261/DIG. 68 |

FOREIGN PATENT DOCUMENTS

| | | | |
|---|---|---|---|
| 450370 | 9/1927 | Fed. Rep. of Germany | 261/41 D |
| 747193 | 6/1933 | France | 261/41 D |

*Primary Examiner*—Ronald H. Lazarus

[57] ABSTRACT

A carburetion system for metering liquid fuel for supply to an internal combustion engine. Liquid fuel is metered in a single bifurcated metering system by being flowed through a calibrated orifice in response to a proportional pressure reduction which is generated as the result of the summing of a venturi pressure reduction and an auxiliary pressure reduction. Metered liquid fuel is delivered through one branch of the metering system to the engine intake air downstream of the throttle at small and medium engine loads, and through the other branch to the engine intake air upstream of the throttle at large engine loads. Transitioning of fuel flow between the branches is automatic and occurs in response to pressure differences within the system. Fuel delivered to the engine intake air downstream of the throttle valve may be heated or otherwise treated to improve liquid fuel atomization or vaporization.

35 Claims, 11 Drawing Figures

LIQUID FUEL CARBURETION SYSTEM

This application is a continuation-in-part of application Ser. No. 888,045, filed Mar. 17, 1978, now abandoned.

BACKGROUND OF THE INVENTION

This invention relates to a liquid fuel metering and supply system for internal combustion engines generally, and more particularly relates to an improved fuel metering system comprising a single bifurcated metering system wherein fuel for all engine operating conditions is metered through a single calibrated orifice or jet in response to a proportional pressure reduction which results as the sum of a venturi pressure reduction and a novel auxiliary pressure reduction.

In prior carburetor art, much effort has been devoted to designing carburetor systems which are capable of accurately metering fuel in response to engine demand at all engine loads. Early in the development of the art, it was discovered that the principle of Venturi could be used to govern the relationship of air and fuel fluid flow in a carburetor system. Engine intake air, when channelled through a duct, would provide a pressure reduction proportional to the quantity of air passing therethrough according to the principle of Venturi. Ideally, this venturi pressure reduction could be used to act directly on liquid fuel to draw it through a calibrated orifice for metering the required proportional amount of fuel for engine operation at various speeds and loads. The practical realities of carburetor construction and engine operation, however, dictated that supplementary means would have to be compounded with the venturi pressure reduction ideal to provide the correct amount of fuel for the various engine operating conditions.

Three things, in particular, served to complicate the basic situation. First, an internal combustion engine requires a numerically higher fuel/air ratio (richer mixture) when idling and operating at light load than when operating at larger loads. This is due, in part, to dilution of the intake fuel/air charge with exhaust gas as a result of overlap in valve timing. A simple venturi metering system cannot provide the necessary light load mixture enrichment. Secondly, the usual carburetor construction employs a constant level fuel reservoir to make fuel available to the metering orifice and to establish a pressure reference for the venturi pressure reduction. Any duct or conduit metering liquid fuel from the fuel reservoir to the air intake must typically pass above the plane of the fuel level to ensure that fuel does not drain or siphon into the air inlet in the absence of the proper metering pressure reduction. A significant supplementary pressure difference is required to raise fuel in the conduit substantially above the plane of the reservoir fuel level. Third, at small engine loads the speed of the intake air through the intake air duct is insufficient to provide good atomization of liquid fuel delivered therein, as would be the case with a simple venturi metering system.

The small magnitude of the venturi pressure reduction at small engine loads makes it very difficult to achieve proper fuel metering for all engine loads using a venturi metering system. Ideally, a venturi pressure signal would provide a substantially constant fuel/air ratio for all load conditions. However, the constant impedance to fuel flow caused by the pressure head of the metered fuel flowing to a conduit above the fuel level interferes with the idle load fuel metering. Under load, the venturi pressure reduction signal has a much larger magnitude than at idle, as the pressure required to raise the fuel above the fuel level may be insignificant insofar as its effect on proper fuel metering. Thus, a carburetor utilizing essentially only a venturi pressure reduction to meter fuel for all engine loads could provide a substantially constant fuel/air ratio whenever the engine was under load, but not for an idling condition. At idling conditions, the fuel/air ratio will be somewhat leaner than the substantially constant fuel/air ratio provided when the engine is under load. To optimize fuel metering under these conditions, the fuel level must be at, or just slightly below, any fuel metering conduit; and, in any case, any fuel metering conduit cannot be substantially above the fuel level.

Thus the small magnitude of the venturi pressure reduction at light engine loads makes it very difficult to achieve proper fuel metering using a simple venturi metering system. Attempts at such carburetor designs necessitate impractical small elevations of fuel above the fuel plane, and complicated arrangements of nozzles and chambers to ensure fuel delivery at all engine loads.

As a result of these problems, many carburetion systems evolved using supplementary fuel metering and supply circuits to augment fuel delivery over that provided by a circuit utilizing the basic venturi pressure reduction fuel supply ideal. Most of these were fuel metering for the various engine load conditions. At the time of this writing, the most common construction employs a basic venturi-operated circuit for large load fuel supply, and separate idle and off-idle transfer circuits for supplying fuel to the engine at smaller loads where the venturi pressure reduction is insufficient to cause fuel to be raised aboe the fuel level into the large load circuit. The idle circuit uses engine induction vacuum downstream of the throttle to provide the pressure difference for metering idle fuel, and the off-idle transfer circuit is progressively exposed to induction vacuum as the throttle valve opens. The use of separate circuits to meter and supply fuel for different engine load conditions necessitates extremely careful design of each circuit, and presents the problem of considerable undesirable variation in the fuel/air ratio when carburetor operation is transistioning from one circuit to another.

A solution to the problems of multiple circuit designs would seem to be to design a carburetion system having basically a single metering circuit which would somehow respond to different intake airflows to meter the correct amount of fuel for all engine load conditions; not have undesirable fuel/air ratio variations; and still be adjustable to suit various applications.

One previous design attempt having a single metering system uses a venturi pressure reduction to cause fuel to flow from a fuel reservoir to a nozzle located very close to an opening which is adjacent the intake air duct. The nozzle directs the metered fuel to a system of ducts and nozzles which deliver the fuel to the intake air downstream from a throttle valve. The intended advantage of the design is to deliver all fuel to the intake air at a location where the air turbulence and speed is sufficient to atomize the liquid fuel, downstream of the throttle valve. The design, however, requires a precisely shaped fluidic device having a carefully spaced interaction zone located in very close proximity to the air intake duct. These special shapes and locations render the design difficult to construct. Additionally, to make use of the venturi pressure reduction at small engine loads, the height that the metered fuel is raised above the plane of the fuel level must be kept as small as possible. This necessitates impractically close control of the fuel level. Finally, the design affords no adjustability from the idle fuel/air ratio.

Another known design meters fuel in a single circuit by employing mechanically variable valves to control the speed of the air in the intake duct and the amount of fuel metered in response. In this design, the intake duct is of rectilinear cross-section and has one wall movable and pivoted so it can vary the cross-section of the intake duct. This movable wall closes the intake duct to a small cross-section at small engine loads, so that the venturi pressure reduction is enchanced due to the relatively greater speed of the intake air. The fuel metering orifice is also of variable cross-section, having a profiled metering needle mechanically coupled to the movable intake duct wall such that the relationship of the openings at any engine load allows the proper amount of fuel to be metered. Since this type of carburetor has a mechanically variable intake duct forming the venturi, it has come to be known in the art as a variable venturi carburetor. Variable venturi carburetors are capable of very precise fuel metering if the needle valve profile is accurately designed, and have the additional advantage of having a strong enough venturi pressure reduction to meter fuel at all engine loads, including idle. The variable venturi carburetor has disadvantages, however, in that its mechanical complexity renders it expensive to construct and prone to mechanical breakdown. Additionally, the precision tolerances involved in the moving venturi and needle valve not only increase the cost of manufacture, but also subject the carburetor to malfunction in the presence of foreign particles or deposits which normally occur over a period of time.

The present invention provides a carburetor which avoids the problems inherent in the previously mentioned known carburetor designs. According to the present invention, there is provided a carburetor of the fixed venturi type, having a single bifurcated metering system comprising a large load circuit or passageway, and a small and medium load circuit or passageway. Since the present carburetor is of the fixed venturi type, the drawbacks due to the mechanical complexity of the variable venturi carburetor are avoided. The present carburetor employs a single metering system which meters fuel through a single calibrated orifice in response to a single net pressure reduction at all speeds and loads, thus avoiding the transition problems of designs having more than one metering system. The metering system of the present carburetor is bifurcated into two circuits or passageways: a small and medium load circuit to deliver fuel downstream of the throttle, and a large load circuit to deliver fuel to the venturi upstream of the throttle. Fuel flow through the two circuits adjusts automatically in response to engine operating conditions. The use of these two circuits ensures better atomization of the fuel at all engine loads. At idle, essentially all fuel is delivered to the intake air downstream of the throttle, where the very high turbulence assures good mixing of the fuel with the air. At large or maximum loads, however, there is little more turbulence downstream from the throttle than upstream. Intake air speed, though, is highest in the venturi at large loads. Therefore, the present invention provides a circuit which delivers large and maximum load fuel to the intake air at the venturi, where the high air speed gives much better fuel atomization than if the large load fuel entered the intake air downstream from the throttle. This provides significantly better large load fuel atomization than designs where large load fuel enters the intake air downstream from the throttle.

Also, a novel auxiliary pressure reduction in the present invention permits fuel to be raised as high as desired above the plane of the fuel level, thus avoiding the drawbacks of previous designs which require this height to be insubstantial.

It has long been recognized in the carburetor art that engine efficiency is enhanced as the homogeneity of the fuel/air mixture is improved. This effect reaches a maximum when the liquid fuel can be completely vaporized for forming the fuel/air intake charge prior to combustion. An engine intake charge so formed allows for an optimal fuel/air ratio and provides excellent cylinder-to-cylinder fuel distrubution characteristics in a multi-cylinder engine. The overall result is very favorable engine operation with respect to fuel consumption and undesirable engine exhaust emissions.

Prior efforts at liquid fuel vaporization generally involved metering the liquid fuel into the engine intake air, subsequently heating the fuel/air mixture, and then delivering the fuel/air mixture to the engine. This method involved extensive rerouting of the intake charge, resulting in mechanical complexity and overall bulk. The method could also be dangerous, in cases where engine exhaust provided vaporization heat and temperature of the fuel/air mixture approached the point of ignition.

There were also attempts to vaporize liquid fuel prior to mixing it with the intake air. The difficulties in vaporizing the fuel without disturbing the relatively small metering pressures make this method very difficult. Such attempts were characterized by complexity, often employing many valves and other mechanical controls to coordinate complicated networks of fuel and air passages.

As a result of their complexity, these previous vaporizing methods were impractical both in construction and operation and never enjoyed common application.

The present invention lends itself well to application of various fuel vaporization techniques, particularly the technique of using engine heat to vaporize the fuel before delivering it to the air intake. Due to the large pressure difference across the low and medium load fuel delivery circuit of the present invention, fuel can be vaporized without detrimental effect on the pressures required for precise fuel metering.

SUMMARY OF THE INVENTION

The purpose of the present invention is to provide a novel fuel supply system which is compact, simple and practical, with few moving parts, which meters a fuel/air mixture ideally suited for efficient engine operation at all engine speeds and loads.

This invention is an improvement in a fixed venturi carburetor wherein liquid fuel is metered in a single metering system, in response to engine demand, by a proportional pressure reduction which is the result of the sum of a venturi pressure reduction and a novel auxiliary pressure reduction. The single metering system is bifurcated into two circuits or passageways: one circuit to deliver fuel at small and medium engine loads to the air intake downstream from the throttle, and another circuit to deliver fuel at large engine loads to the air intake at the venturi upstream from the throttle. In some embodiments of the invention, a fuel vaporizer is interposed in the small and medium load circuit for vaporizing fuel flowing therein. Embodiments having this vaporizer usually allow metered liquid fuel to flow unvaporized through the large load circuit at high power levels, where the effect of allowing the cooler liquid fuel to flow directly into the intake air allows improved volumetric efficiency for greater maximum power output.

The functions described above are achieved as a result of a system which includes a novel carburetor construction having an engine air inlet duct with a venturi constriction of fixed cross-section and a throttle valve downstream from the venturi constriction. A main conduit connects to the inlet duct in the vicinity of the venturi constriction. A fuel conduit connects the main conduit to fuel in a liquid fuel reservoir. An auxiliary conduit connects to the main conduit at a location which is essentially above the level of liquid fuel in the fuel reservoir so that air can flow from the main conduit into the auxiliary conduit at small engine loads. The auxiliary conduit is also connected to the air inlet duct at a location downstream from the throttle. The main conduit has a fluid flowing capacity which is specifically related to the fluid flowing capacity of the auxiliary conduit. The fuel conduit has an effective size such that the correct amount of fuel is metered to the engine. The large load fuel supply circuit comprises the fuel conduit and the main conduit, while the small and medium load fuel supply circuit comprises the auxiliary conduit. The large load circuit is termed the first passageway, and the small and medium load circuit is termed the second passageway.

The operation of the novel carburetor is as follows:

Air for engine operation flows through the inlet duct. The throttle regulates the amount of air flowing through the inlet duct. At small and medium engine loads, the absolute pressure in the inlet duct downstream from the throttle is much less than the pressure upstream from the throttle. The engine intake air flowing through the inlet duct causes a pressure reduction in the venturi constriction proportional to the quantity of air flowing, according to the principle of Venturi. This venturi pressure reduction is applied to the main conduit by virtue of the connection of the main conduit to the venturi constriction in the air inlet duct. Simultaneously, the auxiliary conduit connects the main conduit to a region of very low pressure in the air inlet duct downstream from the throttle. In response to this low pressure, air flows from the main conduit through the auxiliary conduit to the air inlet duct downstream from the throttle. Because air is being withdrawn in this manner from the main conduit, an auxiliary pressure reduction occurs in the main conduit. This auxiliary pressure reduction sums in the main conduit with the previously mentioned venturi pressure reduction to result in a net pressure reduction which acts on the fuel conduit to meter fuel from the fuel reservoir. Fuel metered through the fuel conduit at small and medium engine loads is drawn through the auxiliary conduit and delivered to the air inlet downstream from the throttle. At large loads, the pressure downstream from the throttle will be nearly the same as upstream; so the flow through the auxiliary conduit will be small or nothing. Therefore, at large load, fuel metered from the fuel conduit will flow through the main conduit to the air inlet duct.

To increase fuel vaporization, a heater or vaporizer may be interposed in the auxiliary conduit. The large pressure difference across the auxiliary conduit allows the fuel flowing therein to be vaporized without adversely affecting the pressure reductions required for fuel metering.

The magnitude of the auxiliary pressure reduction is determined by the specific relationship of the fluid flowing capacity of the main conduit to the fluid flowing capacity of the auxiliary conduit. The fluid flow capacity of the auxiliary conduit may be controlled by an adjustable valve interposed in the auxiliary conduit, and by this means the idle fuel/air ratio can be adjusted.

A simplified functional analysis of the present invention reveals that the first or large load circuit is essentially a construction for a theoretically ideal venturi metering system: air flow through the venturi presents a proportional pressure reduction to the fuel conduit to meter the theoretically correct amount of fuel. However, the requirement of raising the fuel out of the fuel reservoir above the fuel level imposes a constant impedance to fuel flow, forcing the actual venturi metering action out of the linear range of operation, particularly at small engine loads. The auxiliary pressure reduction serves to bias the venturi metering action back into an essentially linear range of operation. Simultaneously, provision of the auxiliary conduit forms a second passageway for delivering fuel at small and medium loads to the air inlet, downstream from the throttle, where good atomization can occur.

The present invention can make advantageous use of many features of carburetor construction which are well known in the art. These additional features which may be appended to enhance operation of the invention include: compound or booster venturi constructions to strengthen the venturi pressure reduction; an intake manifold pressure sensitive power valve to increase fuel flow for large load engine conditions; an accelerator pump linked to provide additional fuel upon opening motion of the throttle; annular fuel discharge techniques to distribute fuel evenly into the intake air; float controlled fuel reservoir constructions; and a choke valve to increase the fuel/air ratio for cold engine operation.

The essential novelty of the present invention is the provision, in a carburetor with an air inlet having a fixed venturi, of a single metering system bifurcated into a large load or first passageway, and a small and medium load or second passageway, where the fluid flowing capacity of the first passageway is predetermined in proportion to the fluid flowing capacity of the second passageway, such that air flowed from the first passageway into the second passageway generates an auxiliary pressure reduction in the first passageway having a magnitude sufficient to raise fuel above a fuel reservoir level to the level of the first passageway, where the height the fuel is raised may be as large as desired and need not be minimized; and where fuel flow through the metering system automatically transitions such that essentially all idle fuel flows through the second passageway to a location below an air inlet throttle valve, and essentially all maximum power fuel flows through the first passageway to a location at the venturi upstream from the throttle, and no special nozzles or specially shaped regions are necessary to cause the automatic transition.

Accordingly, a principal objective of the present invention is to provide a carburetion system that is compact and simple, with a minimum of moving parts.

Another object of the present invention is to provide a carburetion system that can generate an auxiliary pressure reduction to provide a bias which compensates for raising fuel out of a fuel reservoir and increasing the small load fuel/air ratio, so that the proportional nature of a venturi generated pressure reduction can be better utilized to meter the correct amount of fuel in response to engine demand.

Another object of the present invention is to provide a carburetion system in which the metered fuel can be delivered to the air intake downstream from the throttle at small and medium engine loads, and to the venturi upstream from the throttle at large engine loads, for better fuel atomization.

Yet another object of the present invention is to provide a carburetion system in which the metered fuel can be vaporized prior to delivery to the air intake downstream from the throttle.

Another object of the present invention is to provide a carburetion system that can use heat produced by the engine to vaporize liquid fuel.

Still another object of the present invention is to provide a carburetion system which can deliver heated vaporized fuel to the engine at small and medium loads for maximum efficiency, and unheated liquid fuel to the engine at large loads for maximum power.

Another object of the present invention is to provide a carburetion system that automatically meters the optimum amount of fuel to the engine for maximum efficiency, resulting in decreased fuel consumption and reduced undesirable exhaust contaminants.

Another important object of the present invention is to provide a carburetion system that can make advantageous use of techniques and constructions known in the art, such as compound or booster venturi constructions, power valves, accelerator pumps, choke valves, and annular fuel discharge techniques.

Other objects, advantages and novel features of the invention will become apparent from the following detailed description of the invention when considered in conjunction with the accompanying drawings, wherein like reference numbers identify like parts throughout.

DETAILED DESCRIPTION OF THE PREFERRED EMBODIMENT

Figure 1:
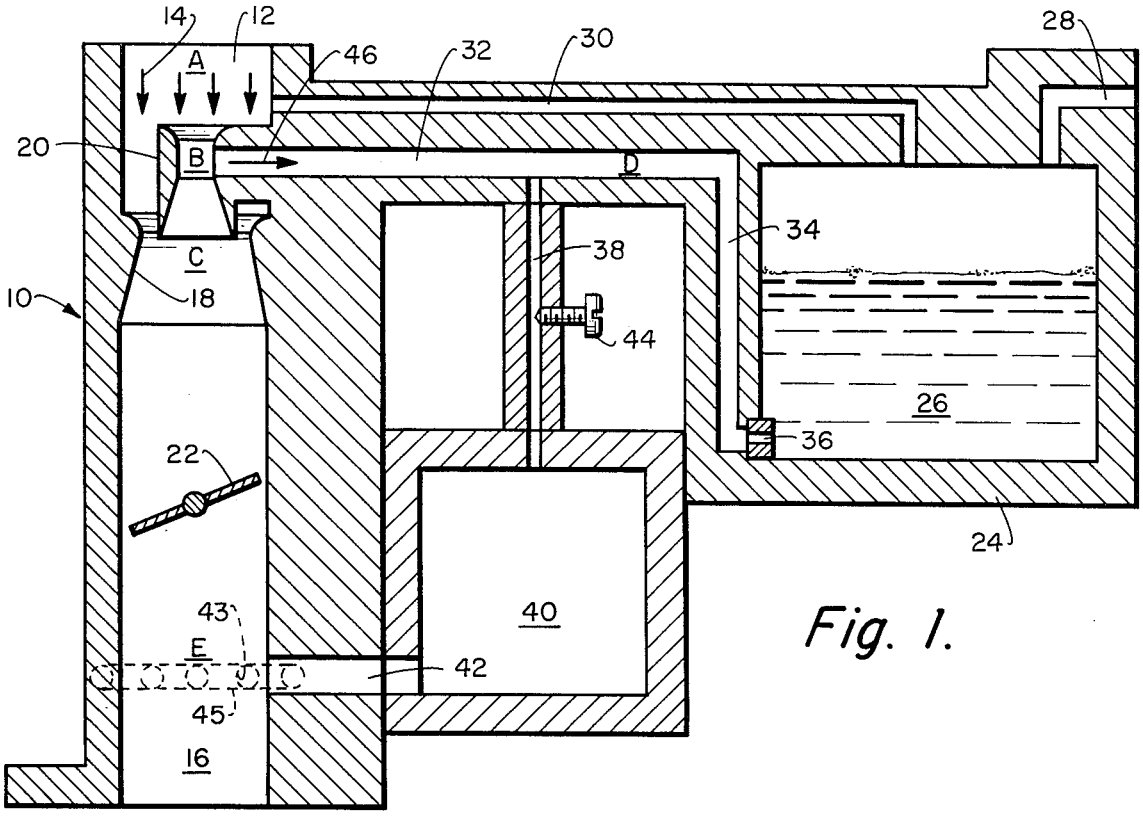
FIG. 1 is a cross-sectional view in semi-schematic form of a carburetor according to the present invention, where a heater is used to vaporize fuel.
Figure 2:
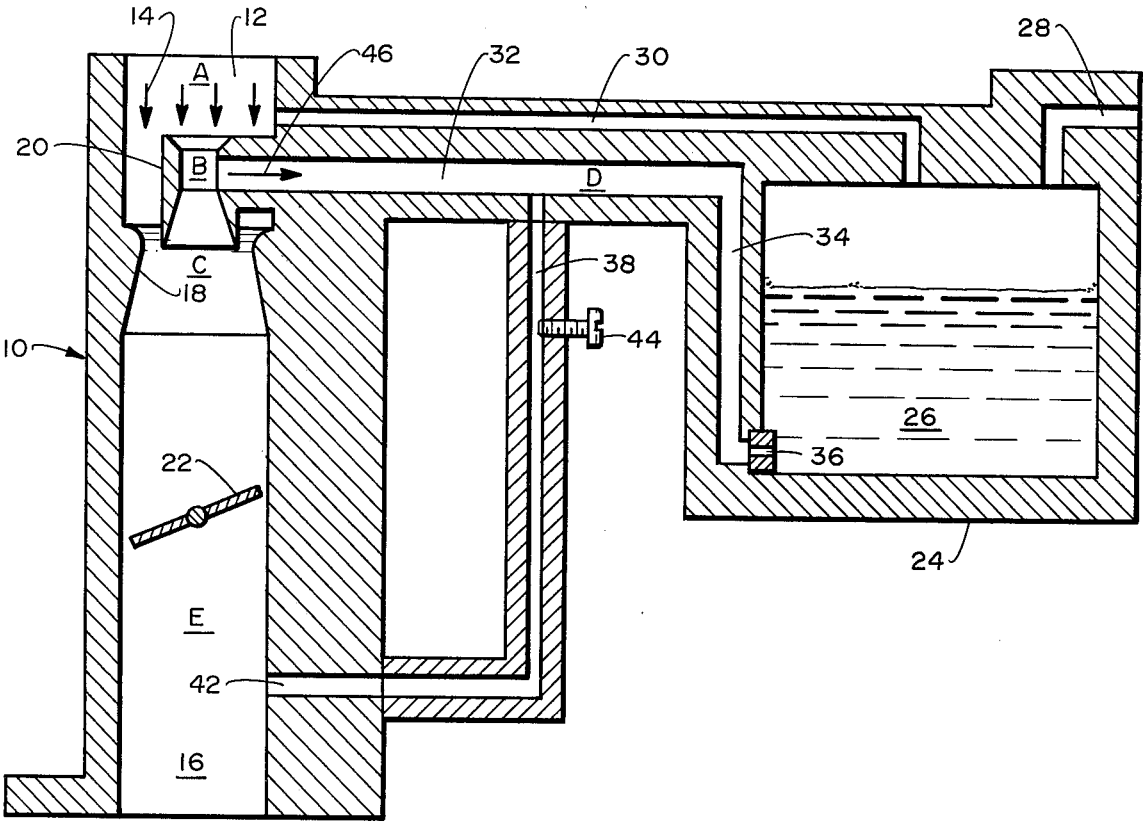
FIG. 2 is a cross-sectional view in semi-schematic form of a carburetor according to the present invention.

Referring to FIGS. 1 and 2, there is provided a carburetor, generally indicated at 10, having an induction air inlet or passageway 12 disposed therein. Through this induction air passageway 12 flows the air necessary to form the fuel/air induction charge to operate the internal combustion engine fueled by the present invention. The induction air flows in the direction indicated by the arrows at 14. The upstream end of the passageway 12 communicates to the atmosphere, preferably through a conventional air filter. The downstream end 16 of passageway 12 communicates to the induction charge intake of the internal combustion engine. Located within passageway 12 is a venturi constriction 18. There is also provided a booster venturi 20, located centrally in passageway 12, such that its lower extremity lies essentially in the plane of the maximum constriction of the venturi 18. Throttle plate or valve 22, shown schematically, provides means to restrict airflow through passageway 12, and may be of conventional design (i.e., butterfly or slide type).

A float chamber, indicated generally at 24, provides a liquid fuel reservoir, wherein the liquid fuel 26 is maintained at a nearly constant level by conventional float valve means (not shown.) Fuel is provided to the float valve controlled fuel reservoir 24 from an external source through fuel inlet 28. Fuel chamber vent 30 communicates into the fuel chamber, above the fuel level, and into passageway 12 upstream of the booster venturi 20. Main fuel/signal conduit or duct 32 communicates into induction air passageway 12 at the narrowest constriction of booster venturi 20. The opening of main fuel/signal duct 32 into booster venturi 20 should be situated such that any liquid fuel emanating from the duct 32 into passageway 12 via venturi 20 will be distributed evenly into the air passing therethrough. Fuel duct or conduit 34 provides a continuous passageway in communication at one end with the liquid fuel 26 below the fuel level, and at the other end into fuel/signal duct 32. These conduits or ducts 32, 34 comprise the main fuel flow path and no nozzle or special port is required at the juncture of duct 34 with duct 32; they need merely communicate with sufficient area to flow the maximum amount of liquid fuel called for by the engine.

Interposed anywhere in fuel duct 34, preferably below the fuel level, is a calibrated metering orifice 36. The purpose of the metering orifice 36 is to pass the proper amount of liquid fuel 26 through the fuel duct 34 in response to metering signals developed within the carburetor in fuel/signal duct 32. Orifice 36 may be adjustable or replaceable with an orifice of different calibration to adjust for optimal fuel/air mixture.

Fuel is delivered, under most operating conditions, to air inlet 12 at 16 through fuel vapor outlet conduit or passageway 42, as shown in FIG. 1, connected to fuel/-signal duct 32 by fuel vaporizing inlet duct or conduit 38. In order to enhance and improve complete vaporization of fuel, vaporizer 40 is interposed between fuel vaporizing conduit 38 and fuel vapor outlet conduit 42.

The fuel vaporizer 40, shown schematically, may comprise a heat exchanger of conventional design, provided with a source of heat (not shown) which may be engine coolant, engine exhaust gas, or even electrical elements. The heat exchanger should be designed with separate internal passageways for fuel and heating fluid, so that no contact occurs between the two fluids to cause contamination of one with the other.

Fuel vaporizing inlet duct or conduit 38 communicates at one end into the internal fuel passageways of fuel vaporizer 40, and at the other end into the main or fuel/signal duct 32. No specially shaped nozzles or ports are required at the juncture of duct 38 with fuel/-signal duct 32; they need merely communicate, with duct 38 opening into fuel/signal duct 32, preferably at or near the bottom portion of fuel/signal duct 32. Fuel vaporizer inlet duct flow adjustment valve 44 is provided to adjust the flow through the fuel vaporizing inlet duct 38. Fuel vapor outlet conduit or passageway 42 communicates at one end into the internal fuel passageways of fuel vaporizer 40, and at the other end into the induction air passageway 12 at 16, downstream of the throttle valve 22. Fuel vapor outlet passageway 42 should communicate into passageway 12 at 16 via one or more ports of suitable size and shape, disposed about the periphery of passageway 12, so as to achieve optimal mixing of vaporized fuel with the induction air. For example, a manifold 45 surrounding the wall of air inlet 12 could have a plurality of ports 43 to distribute the fuel evenly across the air inlet.

There are five pressure regions of interest. One is at the entrance to induction air passageway 12, as indicated by A. Two are in the upper portion of passageway 12, upstream of the throttle valve, as indicated by B and C. The fourth is in the main fuel/signal duct in the general vicinity of the juncture of fuel/signal duct 32 with fuel duct 34, and is indicated at D. The fifth is the pressure region downstream of, or below, throttle valve 22, as indicated by E. Pressure region A is the pressure at the inlet to passageway 12, upstream of or above booster Venturi 20, and remains nearly constantly at or near atmospheric pressure at all engine intake airflows. Pressure region B is the pressure at the narrowest part of the constriction of booster Venturi 20, where the fuel/signal duct 32 opens or intersects into passageway 12, and is essentially proportional to the pressure at region C, which is the pressure at the narrowest part of the constriction of Venturi 18. The pressure at region B is reduced in proportion to the increase in air flow through induction air passageway 12 according to the principle of Venturi. Pressure region E is the pressure in passageway 12 at 16, downstream of the throttle valve, where vapor outlet passageway 42 communicates into the passageway 12. The pressure at E varies widely according to engine speed and throttle valve opening. With the throttle valve closed to the idle position, E is at a high vacuum. As the throttle valve is opened, the pressure at E increases (vacuum decreases), until at wide-open throttle the pressure at E approaches that at region A.

Pressure region D is the pressure herein referred to as the net metering signal, and is developed in the fuel/signal duct 32 as the result of the sum of the Venturi signal and an auxiliary signal, as will be explained in more detail hereinafter.

Fuel/signal duct 32 is sized in relationship to fuel vaporizer inlet duct 38, but must be of sufficient size to conduct the maximum amount of fuel necessary for engine operation, without undue restriction. The size of fuel vaporizer inlet duct 38 must be such that the airflow through it generates, as a maximum, a sufficient auxiliary metering signal in fuel/signal duct 32, while simultaneously conducting the total amount of liquid fuel to be vaporized by vaporizer 40.

For a description of the operation of the invention referred to in FIG. 1, we will begin by assuming that the engine has already been started and is operating at nearly closed throttle, idling condition. Since the air flow through passageway 12 is small at idle, there is only a small Venturi pressure reduction at B; so the pressure in the adjacent part of main fuel/signal duct 32 will not be much less than at A. Pressure region E, however, is at a high vacuum due to the induction pumping action of the engine acting against the nearly closed throttle valve 22. The internal fuel passageways of fuel vaporizer 40 communicate essentially freely (i.e. with low restriction) to pressure region E through vapor duct 42, and hence are nearly at the pressure of region E. Thus, there is a large pressure difference across the fuel vaporizer inlet duct 38, causing an airflow through duct 38 from duct 32 into the internal fuel passageways of fuel vaporizer 40. Air drawn into duct 38 must necessarily flow first through fuel/signal duct 32, as indicated in FIG. 1, by arrow 46. The removal of air from the fuel/signal duct 32 into vaporizer inlet duct 38 causes a pressure reduction in the fuel/signal duct 32, in response to which air flows as indicated at 46. This pressure reduction in duct 32 caused by removal of air from duct 32 into duct 38 shall herein be referred to as the auxiliary metering signal or auxiliary pressure reduction.

The speed of the airflow at 46 through fuel/signal duct 32 is related to the strength of the auxiliary metering signal in that the higher the speed of air at 46 necessary to provide air to replace that drawn into duct 38, the stronger the auxiliary metering signal generated. This effect, in turn, is a function of the ratio of the effective cross-sectional areas of ducts 32 and 38. Consistent with this principle, fuel vaporizer inlet duct flow adjustment valve 44 can be set to alter flow through duct 38, thus adjusting the auxiliary metering signal strength.

The pressure reduction at region B acts upon the adjacent opening of fuel/signal duct 32 to cause a Venturi metering signal pressure reduction to be applied to the duct 32. The pressure reduction in the duct 32 resulting from air being drawn into duct 38, thus causing an airflow from region B into duct 32, is the auxiliary metering signal, and results in a further pressure reduction in duct 32 in addition to that caused by the Venturi metering signal. In effect, the Venturi metering signal and the auxiliary metering signal sum within the fuel/-signal duct 32 to cause a net metering signal to appear at region D, which is the vicinity of the juncture of fuel duct 34 into the fuel/signal duct 32.

The net metering signal at D acts upon the liquid fuel through the fuel duct 34 and metering orifices 36 to cause a fuel flow from the fuel reservoir 24 through the metering orifice 36 and fuel duct 34, up above the fuel level, and into the fuel/signal duct 32. This flow results since the fuel 26 is kept constantly at or near atmospheric pressure by vent 30, and this pressure acts to force proportional amounts of liquid fuel through calibrated orifice 36 in response to the pressure reduction presented by the net metering signal. Liquid fuel flows from fuel duct 34 out into fuel/signal duct 32, and then flows through duct 32 towards the juncture of ducts 38 and 32. The liquid fuel is then drawn into fuel vaporizer inlet duct 38 by the airflow passing into duct 38 from duct 32. All of the liquid fuel under these conditions will be drawn into duct 38, and none will traverse out into the region B, since there is the reverse airflow indicated by arrow 46.

In being drawn into the duct 38, the liquid fuel mixes with the small amount of air flowing therein, forming a fuel/air emulsion. This emulsion then passes into the internal fuel passageways of the fuel vaporizer, where the liquid fuel becomes vaporized as it contacts elements of the heat exchanger heated by the engine coolant, exhaust gases, or electricity, or some combination thereof. The resultant fuel vapor, mixed with some air, then passes into fuel vapor outlet passageway 42, and subsequently passes out into induction air passageway 12 at 16, downstream of the throttle valve 22. The fuel vapor becomes mixed with the induction air to form the fuel/air induction charge for operating the engine.

As the throttle valve is opened further, past the idle position, airflow through passageway 12 is increased, and the Venturi pressure reduction at region B becomes greater. Thus, the Venturi metering signal component in duct 32 becomes greater, resulting in a larger net metering signal at D, causing more fuel to flow through orifice 36, duct 34, and out into duct 32; this greater amount of fuel is drawn into duct 38 and into the fuel vaporizer 40. The resultant greater amount of fuel vapor then passes through passageway 42, to be mixed with the engine induction air. The greater amount of liquid fuel being drawn into duct 38 displaces some of the air formerly drawn in, causing a slight reduction in the airflow through duct 32 shown by arrows 46. This slight reduction in the airflow into duct 38 causes a consequent slight reduction in the auxiliary metering signal strength, but the magnitude of this reduction is much less than the magnitude of the increase of the Venturi metering signal; so an adequate increase in fuel flow through orifice 36 is realized in response to the increase in airflow through passageway 12.

As the throttle valve 22 is opened still further, the Venturi metering signal becomes proportionally stronger in response to the increased airflow through passageway 12. Also, there is less pressure reduction in region E, which, combined with the additional displacement of air from duct 38 by the liquid fuel being drawn therein, causes a reduction in airflow through duct 38, resulting in a significantly decreased auxiliary metering signal.

As the throttle valve 22 is opened still further, a point is reached where not all of the metered liquid fuel flowing into duct 32 can be drawn into duct 38; so the remainder flows past the juncture of ducts 32 and 38, out into the induction air where duct 32 intersects or opens into region B. This is possible since, at this point, the airflow at 46 is very small or non-existent.

At wide-open throttle, the pressure at E may actually be greater than the pressure at B, so there will be no flow from duct 32 into duct 38. All of the metered liquid fuel flowing into duct 32 will continue through duct 32, and be delivered to the main induction airstream at region B. At this point, the induction air speed through region B will be high enough to ensure good mixing of the liquid fuel with the induction air. Also, at this point of engine operation, the auxiliary metering signals has disappeared, and the net metering signal consists entirely of the Venturi metering signal.

The gradual reduction of the auxiliary metering signal with increasing engine load results in one of the desirable features of the invention, that is, a fuel/air mixture that is slightly richer at idle, but becomes leaner with increasing engine load.

From the description of the invention thus far, the advantageous operation of the novel fuel metering system becomes apparent. At idle, the auxiliary metering signal is the predominant component of the net metering signal. This auxiliary metering signal component provides a sufficient pressure reduction to elevate liquid fuel up from the liquid fuel reservoir level to the level where the metered fuel is transported for ultimate delivery to the engine induction air. Additionally, it can provide for a fuel/air mixture that is slightly richer at idle, and adjustable at idle and light engine loads.

Moreover, it becomes readily apparent how advantageous it is to utilize the energy available from the engine induction vacuum to draw liquid fuel through a vaporizing device.

There are variations of the embodiment of the invention described above, some of which are illustrated in FIGS. 2 and 3. First, adjustment valve 44 can be eliminated if ducts 32 and 38 are properly matched in size, although at a loss of some flexibility of use, since the idle fuel/air ratio will not be adjustable. Secondly, this construction shows not only a Venturi constriction 18, but also a booster Venturi 20. It has been shown that the invention will operate satisfactorily using only a single Venturi, or no specially shaped Venturi constriction at all, as long as liquid fuel emanating into the induction air from the fuel/signal duct 32 can be satisfactorily mixed with the induction air. However, it has been found advantageous to maximize the Venturi metering signal; therefore, it is preferable to employ a Venturi, or, better, compounded Venturis, as shown. Thirdly, the fuel vaporizer 40 need not be an integral physical part of the carburetor. However, if it is separate, the distance of separation, and resultant elongation of duct 38 and passageway 42, should not be so great as to interfere with proper operation of the system as a whole.

Considering the relationship of fuel duct 34 and vaporizer inlet duct 38 with fuel/signal duct 32, satisfactory operation results as long as neither of the openings of duct 34 into duct 32 or duct 38 into duct 32 is closer to the opening of duct 32 into region B of air inlet 12, than a distance equal to at least approximately the perimeter of the opening of duct 32 into region B and preferably three to four or more times the diameter. Additionally, the opening of duct 38 into duct 32 should be physically distant enough from the opening of duct 34 into duct 32 so that the effect on duct 34 of local vacuum extremes near the opening of duct 38 does not predominate over the desired Venturi and auxiliary metering signals.

Figure 3:
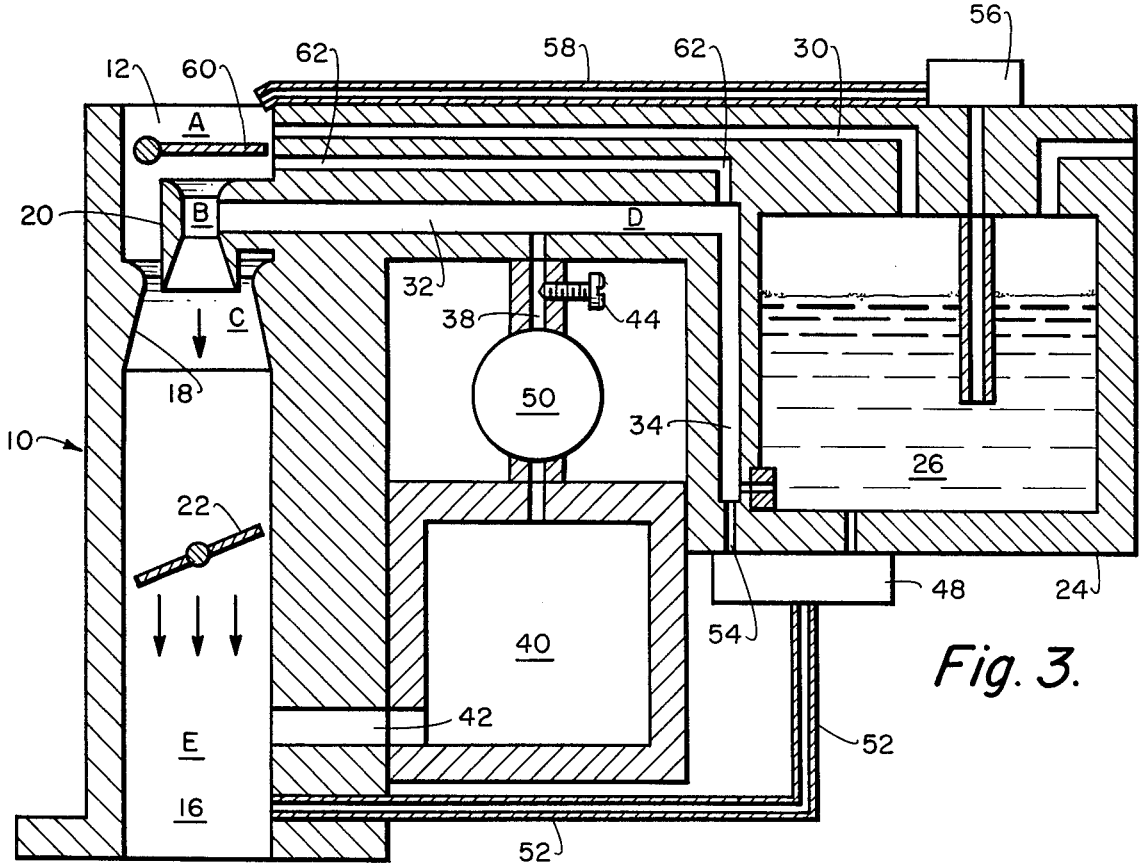
FIG. 3 is a cross-sectional view in semi-schematic form of a carburetor according to the present invention, illustrating several supplementary features.

FIG. 3 illustrates several additional and useful features which can be used to complement the functioning of the basic embodiment of the invention as described in FIG. 1.

An auxiliary device 50, shown schematically, which need not be, but may be, a pump of any conventional design, supplants or supplements the need for engine induction vacuum to draw air and fuel into the fuel vaporizer inlet duct 38. Use of pump device 50 provides the benefit of being able to force all of the metered liquid fuel from fuel/signal duct 32 into the fuel vaporizer 40 at all engine speeds and loads, including wide-open throttle.

A valve 48, shown schematically, may be provided to supply additional fuel to enrich the mixture at high engine loads. Valve 48 is sensitive to and controlled by engine induction vacuum at region E through conduit or passageway 52. When the pressure at region E rises to a predetermined value, valve 48 opens to allow liquid fuel 26 to flow through calibrated duct 54 into fuel duct 34. Calibrated duct 52 operates in parallel with metering orifice 36. This valve has a construction and function similar to a device commonly referred to as a "power valve" in the carburetor art.

A pump 56, shown schematically, may also be provided to supply a small amount of additional liquid fuel to the induction air inlet 12 under conditions of opening motion of the throttle valve 22. The pump 56 is actuated by a connection to the throttle valve linkage (not shown) to draw liquid fuel from reservoir 24 and deliver it to the induction air inlet 12 via conduit or duct 58. This pump is similar in construction and function to a device commonly referred to as an "accelerator pump" in the carburetor art.

A valve 60, shown schematically, may be located at the entrance to the induction air passageway 12, as shown, upstream of the booster Venturi 20. In a closed or partially closed position, the valve 60 serves to impede the flow of main induction air, to provide a stronger pressure reduction signal to fuel/signal duct 32 via region B. The valve 60 may be manually or thermostatically operated to be closed or partially closed a predetermined amount in response to the degree to which the engine has not reached operating temperature. The additional pressure reduction at region B resulting from the operation of valve 60 causes an enrichment of the fuel/air mixture when the engine is cold. This valve is similar in function and construction to the device commonly known as a "choke valve" in the carburetor art.

An air bleed conduit 62, communicating into fuel/signal duct 32 from region A, may be provided to introduce a metered amount of air into the fuel/signal duct 32 near the juncture of fuel duct 34. The air so provided acts on the liquid fuel issuing from duct 34, enhancing its flow through duct 32.

It will be noted in reference to FIGS. 1, 2 and 3, if a conventional float valve fuel chamber is used for chamber 26, the liquid fuel level must be maintained lower than the level of the opening of fuel duct 34 into fuel/signal duct 32. Otherwise, liquid fuel would spill into duct 32 solely under the influence of gravity, interfering with proper fuel metering and flooding the engine when not operating. Also, due to the novel and useful auxiliary metering signal feature of the present invention, it is not critical how far the fuel level is below the juncture of ducts 34 and 32, since the auxiliary metering signal can be adjusted to draw liquid fuel up substantially above the fuel chamber or reservoir 24. If a conventional float valve chamber is not used to provide fuel to orifice 36 and duct 34, any constant pressure supply system may be used, as long as fuel pressure is not so high as to force fuel into duct 32 in the absence of any metering signal.

FIG. 2 illustrates a carburetor as in FIG. 1, but without the fuel vaporizer. The embodiment of FIG. 2 has an inlet duct 12, a main or fuel/signal conduit 32, a fuel conduit 34, and an auxiliary conduit 38. Auxiliary conduit 38 has essentially the same function as the vaporizer conduit 38 of FIG. 1. In FIG. 2, the auxiliary pressure reduction is generated and its magnitude determined by the ratio of the effective cross-sections or fluid flowing capacities of conduits 32 and 38, in the same manner as was described for FIG. 1. Fuel is delivered, unvaporized, directly to duct 12 by conduit 38 at low and medium engine loads.

Figure 4:
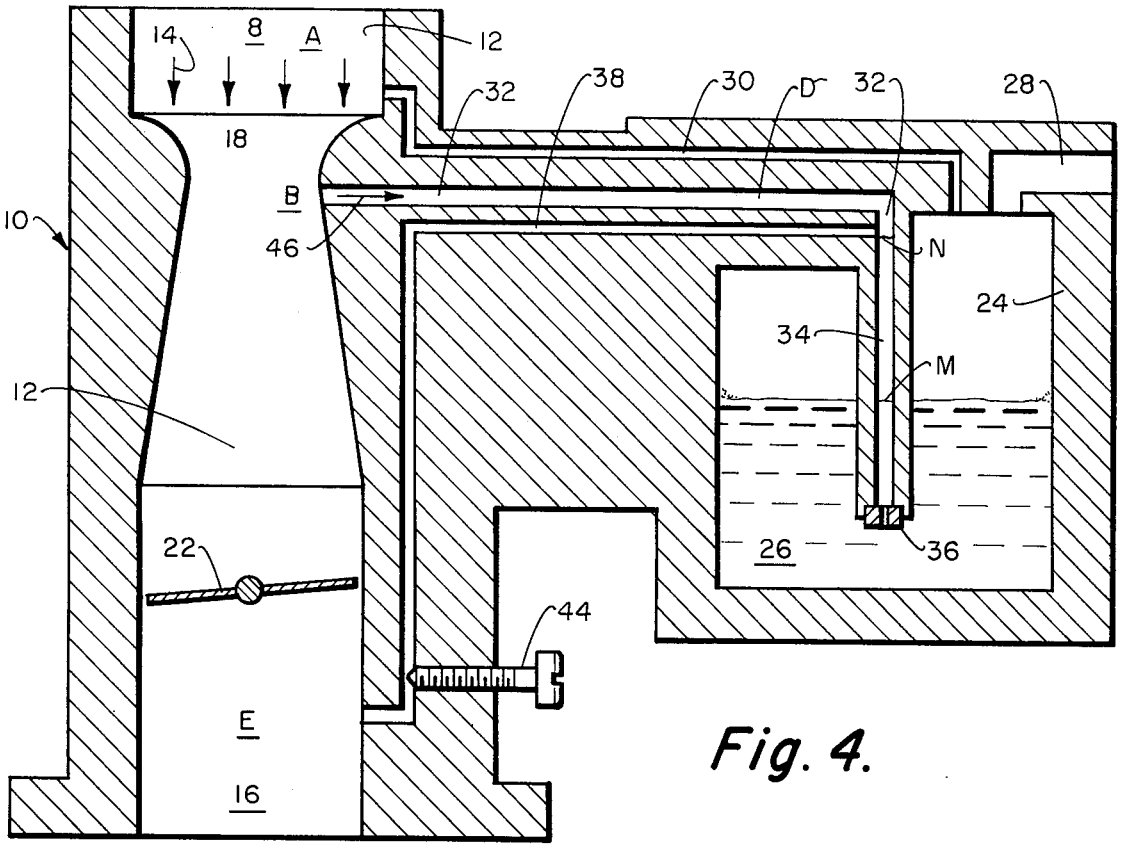
FIG. 4 is a cross-sectional view in semi-schematic form of a carburetor according to the present invention, wherein the fuel conduit is centered over the fuel reservoir.

FIG. 4 illustrates an embodiment of the invention wherein no special vaporizer is employed, and which is particularly well suited for providing fuel to an automotive internal combustion engine. The following detailed description of the embodiment of FIG. 4 will further illustrate and clarify the novelty of the present invention as was first detailed in reference to FIG. 1, which included a special liquid fuel vaporizer.

Referring to FIG. 4, there is provided a carburetor, generally indicated at 10, having an air inlet duct or passageway 12 disposed therein. Through this air inlet 12 flows the intake air necessary to form the fuel/air charge to operate the internal combustion engine fueld by the present invention. The intake air flows in the direction indicated by the arrows at 14. The upstream end 8 of the inlet 12 communicates to the atmosphere, preferably through a conventional air filter. The downstream end 16 of inlet 12 communicates to the fuel/air charge intake of the internal combustion engine. Located within duct 12 is a Venturi constriction 18. Throttle valve 22, shown schematically, provides means to restrict airflow through inlet duct 12, and may be of conventional design (i.e. butterfly or slide type).

A fuel chamber, indicated generally at 24, provides a liquid fuel reservoir, wherein the liquid fuel 26 is maintained at a nearly constant level by conventional float valve means (not shown). Fuel is provided to the float valve controlled fuel reservoir 24 from an external source through fuel inlet 28. Fuel chamber vent 30 is connected to the fuel chamber, above the fuel level, and connected to duct 12 upstream of the Venturi 18. A main conduit 32 has a connection or intersection with inlet duct 12 at the narrowest constriction of the Venturi 18. A fuel conduit 34 is located centrally in or above the fuel reservoir, and communicates to the liquid fuel 26 below the fuel level in the reservoir. Interposed in fuel conduit 34, preferably below the fuel level, is a calibrated metering orifice 36. The metering orifice 36 is calibrated to flow the proper amount of liquid fuel 26 through the fuel conduit 34 in response to pressure reductions generated in the carburetor. Orifice 36 may be adjustable, or replaceable with an orifice of different calibration, to adjust for optimum fuel/air mixture ratio. Fuel conduit 34 is connected to main conduit 32. The conduits 32 and 34 together constitute the first, or large load fuel supply passageway, and no nozzle or specially shaped port is required at their juncture; they need merely communicate with sufficient area to flow the maximum amount of liquid fuel metered to the engine. The opening of main conduit 32 into the Venturi 18 is such that liquid fuel emanating from the conduit 32 into duct 12 will be distributed into the air passing therethrough.

An auxiliary conduit 38 is connected to the main conduit 32 at a location centrally above the fuel in the fuel reservoir. The other end of auxiliary conduit 38 is connected to the downstream end 16 of the air inlet duct 12, at a location downstream from the throttle valve 22. Auxiliary conduit 38 constitutes the second, or small and medium engine load fuel supply passageway, and no nozzle or specially shaped port is required at the connection of conduits 38 and 32. Auxiliary conduit flow adjustment valve 44 is provided in conduit 38 to adjust the flow through auxiliary conduit 38.

Main conduit 32 is specifically sized in relation to the flow capacity of auxiliary conduit 38, but conduit 32 should be of sufficient size to transport the maximum amount of fuel necessary for engine operation under large load conditions. Auxiliary conduit 38 must be of at least sufficient capacity to simultaneously conduct air and engine idle fuel at engine idle conditions.

There are four pressure regions of special interest that occur during operation of the carburetor. One is the pressure region at the upstream entrance to air inlet duct 12, as indicated at A. Pressure region A is upstream of the Venturi in duct 12, and remains essentially at or near atmospheric pressure at all intake airflows. The connection of fuel chamber vent 30 to duct 12 occurs at pressure region A, and by virtue of this connection the pressure in the fuel chamber above the fuel level is maintained at essentially the same pressure as region A. The second pressure region is indicated at B, and is the pressure in the Venturi portion 18 of the air inlet duct 12. The pressure in region B is proportional to the speed of airflow through the region, according to the principle of Venturi. Main conduit 32 is connected to duct 12 at region B, so the pressure in region B is applied to conduit 32. The pressure in region B as applied to conduit 32 shall hereafter be referred to as the Venturi pressure reduction. The third pressure region is in the downstream end 16 of the duct 12, and is indicated at E. The pressure in region E varies widely according to engine speed and throttle valve opening. When the throttle valve is closed to the idle position, E is at high vacuum. As the throttle valve is opened, the pressure at E increases (vacuum decreases). When the throttle valve is open to its maximum extent, the pressure at E approaches the pressure in region A. The auxiliary conduit 38 is connected to duct 12 at region E; so the pressure in region E is applied to conduit 38. The fourth pressure region is the pressure in the main conduit and is indicated by D. The pressure at D serves to meter fuel from the fuel conduit, and will hereafter be referred to as the net pressure reduction. Due to the novelty of the present construction, the pressure D will always be less than or equal to the pressure in region B, as will be explained in greater detail below.

For a description of the operation of the embodiment of the invention shown in FIG. 4, it will be assumed that the engine has not yet been started, so is not operating. Under these conditions there is no airflow through air inlet 12, and pressures in regions A and E are the same. The fuel level in fuel conduit 34 will be as shown at M, and is the same level as the fuel in reservoir 24. As soon as the engine is started, the fuel level in fuel conduit 34 will rise to the level shown at N due to the action of an auxiliary pressure reduction which will be described in more detail below. When the engine has been started and is idling, the throttle valve is nearly closed and the air flow through duct 12 is small. Therefore, the speed of flow through the Venturi 18 will be slow, and the pressure at region B will not be much less than at region A. There will therefore be only a very small Venturi pressure reduction applied to main conduit 32 at its connection to passageway 12. The pressure in region E, however, is at a high vacuum due to the induction pumping action of the engine acting against the nearly closed throttle valve 22. The high vacuum at region E is applied to auxiliary conduit 38 at its connection with duct 12. The connection of conduit 38 with main conduit 32 is at a much higher pressure than region E, since only a small Venturi pressure reduction was applied to conduit 32 from region B. The result of these relative pressures is that a large pressure difference exists from one end to the other of auxiliary conduit 38. In response to that pressure difference, there is an airflow through conduit 38 which causes air to flow out of conduit 32, through conduit 38, and into duct 12. Air flow from conduit 32 into conduit 38 results in an equivalent of air flow from duct 12 into and through conduit 32, as shown by arrow 46.

Certain pressure relationships related to the abovementioned airflows can now be examined. Air flowed through conduit 38 must be flowed out of conduit 32. This causes a pressure reduction in conduit 32, which shall hereafter be referred to as the auxiliary pressure reduction. The amount of air flowed through conduit 38 in response to the vacuum in region E is determined by the size, or fluid flowing capacity, of conduit 38. Since the amount of air flowing from passageway 12 into main conduit 32 is normally the same as the amount of air flowing from conduit 32 into conduit 38, it can be seen that the fluid flowing capacity of conduit 38 determines the airflow through conduit 32 as shown by arrow 46.

Stated another way, the airflow through conduit 32 is essentially fixed by the fluid flowing capacity of conduit 38. Referrring now to main conduit 32, since the airflow through conduit 32 is fixed by the flow through conduit 38, the auxiliary pressure reduction in conduit 32 can be set to a desired value by setting the size or fluid flowing capacity of conduit 32. Thus, the fluid flowing capacity of conduit 32 is specifically related to the fluid flowing capacity of conduit 38 to determine the magnitude of the auxiliary pressure reduction.

Furthermore, since the magnitude of the Venturi pressure reduction applied to conduit 32 is relatively much smaller than the pressure difference across conduit 38, the magnitude of the auxiliary pressure reduction can remain practically stable during variations of the Venturi pressure reduction. Since the upper pressure reference for conduit 32 is the pressure at region B, which is the Venturi pressure reduction, the auxiliary pressure reduction represents yet a further decrease in pressure in conduit 32. Thus, the auxiliary pressure reduction effectively sums or acts cooperatively with the Venturi pressure reduction to cause the net pressure reduction in conduit 32 shown at D. Therefore, the pressure D is always at or lower than the pressure at region B.

The net pressure reduction at D acts on the fuel conduit 34. Since the pressure in the fuel chamber is maintained at the relatively high pressure at region A by chamber vent 30, pressure reduction D causes a fuel flow in conduit 34, metered by calibrated orifice 36. When the engine is not operating, the fuel level in fuel conduit 34 is even with the fuel level in the fuel reservoir as shown by M. When the engine is operating at small loads and the auxiliary pressure reduction has been set to the proper value, the fuel will rise through fuel conduit 34 until it reaches the connection of conduit 38 with conduit 32, as shown by N. There is a resistance to fuel flow caused by the force of gravity acting on the column of fuel that has been raised the distance M-N above the fuel level. As long as the fuel level in the region of conduit 34 remains essentially constant, the resistance to fuel flow due to the column of fuel between M and N will remain essentially constant, and can be compensated for by the presence of the novel auxiliary pressure reduction. Upon being raised to the level at N, metered liquid fuel reaches the vicinity of the connection of conduit 38 with conduit 32 where it is drawn into conduit 38. The strong flow into conduit 38 ensures that all the liquid fuel is drawn therein, and the airflow in conduit 32 as indicated by arrow 46 resists any fuel flowing through conduit 32 into passageway 12. In being drawn into conduit 38, the liquid fuel mixes with the air flowing therein, forming an emulsion of the two fluids. This emulsion then flows through conduit 38 and is delivered to duct 12 near region 16, downstream of the throttle valve 22.

As the throttle valve 22 is opened further, past the idle position, airflow through duct 12 is increased, and the Venturi pressure reduction at region B becomes greater. Thus, the Venturi pressure reduction component in conduit 32 becomes greater, resulting in a larger net pressure reduction at D, causing more fuel to flow through orifice 36 and conduit 34 to conduit 32. This greater amount of fuel is drawn into conduit 38. The resultant greater amount of fuel then passes through conduit 38 to be mixed with the engine intake air. The greater amount of liquid fuel being drawn into conduit 38 displaces some of the air formerly drawn in from conduit 32, causing a slight decrease in the air-flow through conduit 32, shown by arrow 46. This slight decrease in the airflow into conduit 38 reflects a consequent slight decrease in the auxiliary pressure reduction strength, but the magnitude of this decrease is much less than the magnitude of the increase of the Venturi pressure reduction; so an adequate increase in fuel flow through orifice 36 is realized in response to the increase in airflow through duct 12.

As the throttle valve 22 is opened still further, the Venturi pressure reduction becomes proportionally stronger in response to the increased airflow through duct 12. Also, there is less vacuum in region E, which, considered with the additional displacement of air from conduit 38 by the liquid fuel being drawn therein, causes a decrease in airflow through conduit 38, resulting in a significantly decreased auxiliary pressure reduction.

As the throttle valve 22 is opened still further, a point is reached where not all of the metered liquid fuel flowing to conduit 32 can be drawn into conduit 38; so the remainder flows past the connection of conduits 32 and 38, out into the inlet duct where conduit 32 opens into region B. This is possible since, at this point, the airflow at 46 is very small or non-existent.

At wide-open throttle, the pressure at E may actually be greater than the pressure at B, so there will be no flow from conduit 32 into conduit 38. All of the metered liquid fuel flowing into conduit 32 will continue through conduit 32, and be delivered to the intake airstream at region B. At this point, the intake air speed through region B will be high enough to ensure good mixing of the liquid fuel with the intake air. Also, at this point of engine operation, the auxiliary pressure reduction has disappeared, and the net pressure reduction consists entirely of the Venturi pressure reduction. It will be noted that the net pressure reduction at D will always be greater than or equal to the Venturi pressure reduction at B, depending upon the magnitude of the auxiliary pressure reduction. Hence, the actual effective pressure reduction which acts to meter fuel in the carburetor is stronger than would be a Venturi pressure reduction acting alone.

The auxiliary pressure reduction is determined such that it sums with the Venturi pressure reduction to provide a net pressure reduction of the correct magnitude to meter the proper amount of fuel through orifice 36 for all engine loads. Adjusting the magnitude of the auxiliary pressure reduction, as previously described, is a function of specifically relating the fluid flow capacities of main conduit 32 and auxiliary conduit 38. Valve 44 can be used advantageously for precise adjustment of the idle fuel/air mixture. Normally, the absolute cross-section of conduit 32 will be quite a bit larger than the absolute cross-section of conduit 38, due to the very large pressure difference that exists across conduit 38 under most conditions.

A particularly interesting characteristic of main conduit 32 is its bidirectional fluid flow capability. At small and medium engine loads, it flows air out of and away from duct 12. At large engine loads, it flows fuel towards and into duct 12.

Figure 5:
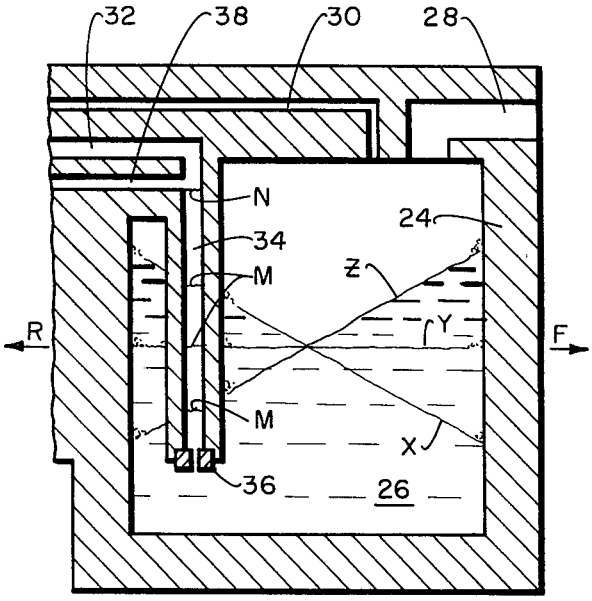
FIG. 5 is a cross-sectional view in semi-schematic form of a fuel reservoir as used in the present invention, showing the location of a fuel conduit and various planes of liquid fuel levels for various acceleration conditions.
Figure 6:
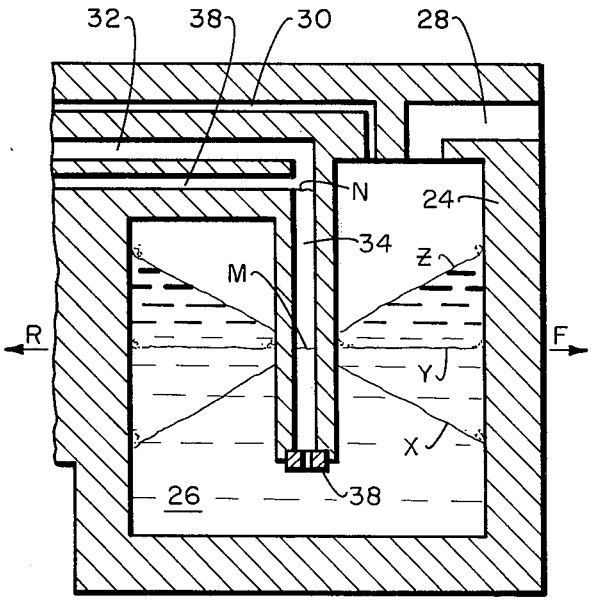
FIG. 6 is a cross-sectional view in semi-schematic form of a fuel reservoir as used in the present invention, showing an alternate location of a fuel conduit and various planes of liquid fuel levels for various acceleration conditions.

In the configuration of the invention as shown in FIG. 4, it is especially important that auxiliary conduit 38 connect to main conduit 32 at a location that is centered above the liquid fuel reservoir. This location tends to minimize adverse effects on accurate fuel metering due to a change in the angle of the plane of the fuel level resulting from a change in velocity of any machine to which the carburetor might be attached. Reference is made to FIGS. 5 and 6 for a more detailed explanation. FIG. 5 illustrates a fuel reservoir of the present invention where the auxiliary conduit 38 connects to the main conduit 32 at a location that is not centered above the fuel in the reservoir. The plane of the liquid fuel is shown for three different velocity conditions at X, Y and Z. X is the plane of the fuel level if the carburetor is being accelerated in the direction indicated by arrow F; Y is the plane of the fuel level for no acceleration; and Z is the plane of the fuel level if the carburetor is being accelerated in the direction indicated by arrow R. For any given throttle opening and engine speed, the net pressure reduction acting on orifice 36 in fuel conduit 34 will be constant, and will tend to cause a constant fuel flow through orifice 36 due to the fact that the fuel chamber is maintained at a relatively higher pressure by virtue of vent 30, as previously described. However, the auxiliary pressure reduction is set so that the liquid fuel is raised a fixed distance M-N above a fuel level that is nearly constant. As can be clearly seen from FIG. 5, the fuel level M below the connection of conduits 38 and 32 changes considerably as the plane of the fuel level shifts for the different acceleration conditions as shown by X, Y and Z. Therefore, the height that the fuel is raised above the fuel level is also considerably different for the different acceleration conditions. Any time the height that the fuel is raised above the fuel level changes, the effective pressure across the orifice 36 changes, altering the fuel flow. Thus, it is seen that even for constant throttle opening and engine speed conditions, fuel metering will vary with different acceleration conditions. The undesirable variance of fuel flow resulting from acceleration can be avoided by the construction shown by FIG. 6. FIG. 6 shows a fuel reservoir of the present invention where the auxiliary conduit 38 connects to the main conduit 32 at a location that is essentially centered above the fuel in the reservoir. The various planes of the liquid fuel level are shown by X, Y and Z, and are the same as described for FIG. 5. It can be seen from FIG. 6 that the changes in the plane of the fuel level for different acceleration conditions do not affect the fuel level M in the region below the connection of conduit 38 to conduit 32. Therefore, the height M-N that the fuel is raised above the fuel level remains essentially constant. Thus, the construction shown in FIG. 6 eliminates undesirable fuel flow variations due to acceleration.

Centering the intersection of conduits 38 and 32 over the fuel reservoir depends, of course, upon the geometry of the fuel chamber itself. What is desired, specifically, is locating the connection of conduit 38 to conduit 32 directly over the region where the fuel level undergoes the least change in elevation for various acceleration conditions. Therefore, what is meant by "centering" is the locating of the connection of auxiliary conduit 38 with main conduit 32 essentially directly above the region of least change in elevation of the fuel level for various conditions of acceleration of the carburetor. It is foreseeable that it may be desirable to locate the connection of conduits 38 and 32 slightly away from centered above the fuel reservoir, to take advantage of fuel flow variations due to acceleration for specific or unique applications or uses of the present invention. Also, the carburetor may be made to function in unusual operating attitudes or positions, by correctly locating the intersection of conduits 38 and 32 over the fuel reservoir.

FIG. 4 shows a calibrated orifice 36 in fuel conduit 34 to meter the fuel in response to the net pressure reduction at D. It is possible to dispense with a special calibrated orifice if conduit 34 itself is properly sized to perform the function.

The length of main conduit 32 is not important, as long as its length exceeds a distance approximately equal to one-half its perimeter where it joins duct 12. If conduit 32 is not of sufficient length, it will not generate a proper auxiliary pressure reduction due to local non-uniform changes in airflow velocity. If the length of conduit 32 is essentially zero, there will be virtually no auxiliary pressure reduction.

The height M-N that the fuel is raised above the fuel level may be set over a wide range of possible values, due to the operating nature of the novel auxiliary pressure reduction. Essentially any height can be achieved, consistent with sound carburetor engineering principles. This allows conduit 32 to be located substantially above the fuel level.

FIG. 4 shows an air inlet 12 with a specially shaped Venturi constriction 18, the narrowest part of which generates pressure region B. In theory, no specially shaped constriction need be employed, since the principle of Venturi would operate even if inlet 12 were only a straight-walled tube. In practice, however, better results are obtained using carefully designed Venturi shapes.

Figure 7:
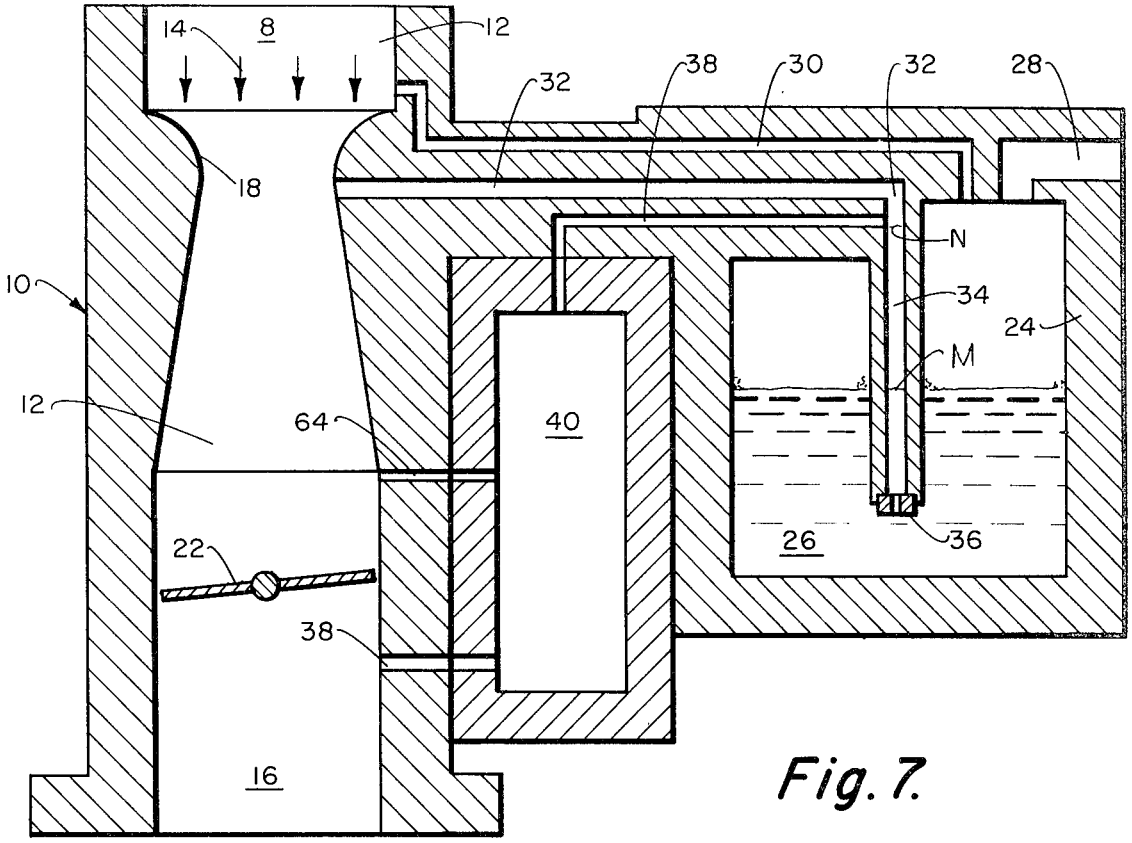
FIG. 7 is a cross-sectional view in semi-schematic form of a carburetor according to the present invention, where a vaporizer is used to enhance fuel vaporization.

Referring to FIG. 7, an embodiment of the invention is illustrated which improves liquid fuel vaporization at small and medium engine loads. The construction of FIG. 7 is identical to the construction of FIG. 4, except that vaporizer 40 is interposed in auxiliary conduit 38. The fuel vaporizer 40, shown schematically in FIG. 7, may comprise a heat exchanger of conventional design, provided with a source of heat (not shown) which may include engine coolant, engine exhaust gas, or even electrical elements. The heat exchanger should be designed so that there is no direct contact of fuel with any heating fluid, so that one does not contaminate the other.

In operation, fuel is metered through fuel conduit 34 by the net pressure reduction which results from the sum of the Venturi and auxiliary pressure reductions. At low and medium engine loads, this fuel is drawn into conduit 38. In flowing through conduit 38, the fuel passes through the vaporizer where heat changes the liquid fuel to a vapor. The resulting fuel vapor, mixed with air which flowed from main conduit 32, flows out of conduit 38 into inlet duct 12 downstream from throttle 22. At large engine loads, liquid fuel flows through main conduit 32 to the inlet duct 12.

To accommodate the added fluid volume which results from vaporization of the liquid fuel, the portion of conduit 38 extending between vaporizer 40 and air inlet 12 may be enlarged. It is even possible to arrange the relative sizes of the portions of conduit 38 on either side of the vaporizer such that there is an advantageous effect on the auxiliary pressure reduction to enhance the fuel/air ratio for cold engine operation. Also, an adjustable valve may be employed anywhere in conduit 38 for adjusting the auxiliary pressure reduction, as was done by valve 44 in FIG. 4.

The vaporizer shown schematically in FIG. 7 at 40 need not be a heat exchanger, but may be any of the several known vaporizing devices, some of which operate mechanically and some of which use special fluid flow effects. The vaporizer may even employ a sonic or high velocity nozzle operated by engine idle airflow.

Also, air from air inlet 12, preferably downstream from Venturi 18, may be admitted to vaporizer 40 through duct 64 to enhance vaporization of liquid fuel by the process of evaporation. The evaporated fuel along with the air from duct 64 will be delivered to the air inlet 12 downstream of throttle valve 22 by the conduit 38. It is convenient to close throttle 22 completely, and allow engine idle air to bypass the throttle through duct 64, vaporizer 40, and conduit 38.

Figure 8:
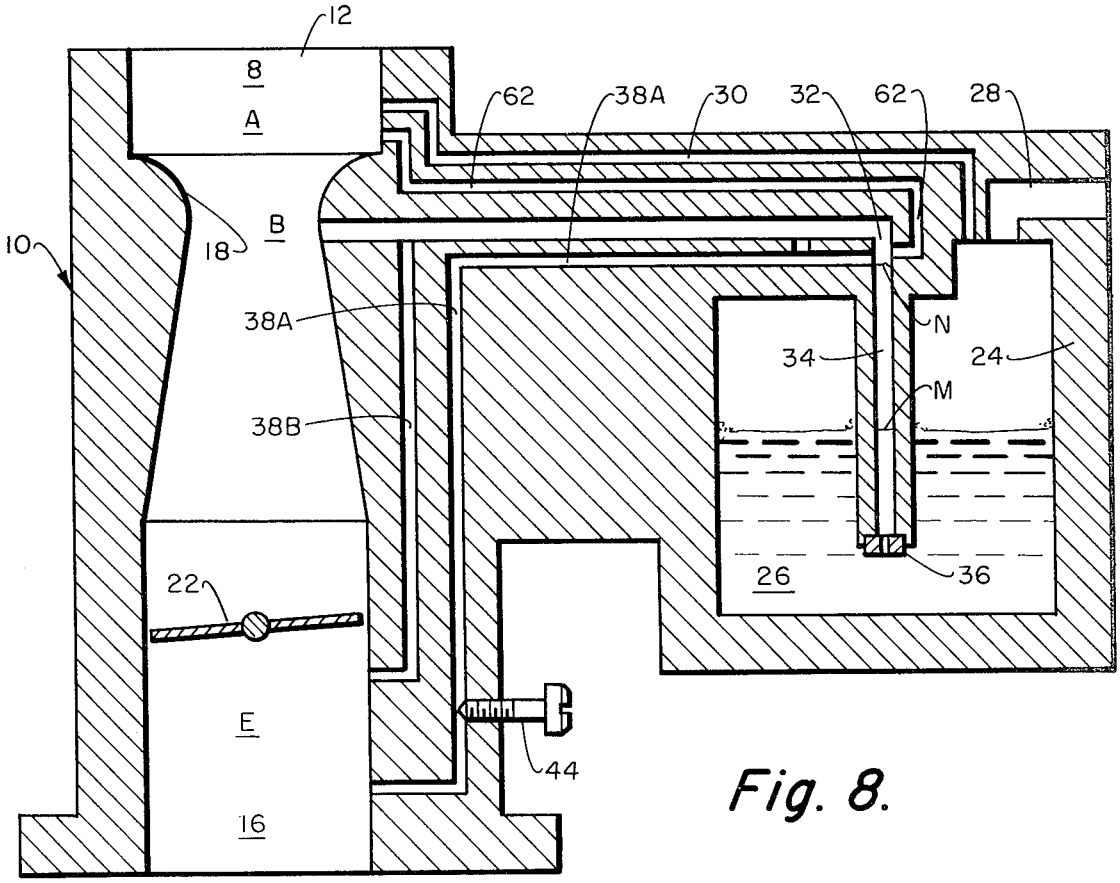
FIG. 8 is a cross-sectional view in semi-schematic form of a carburetor according to the present invention, illustrating several conduit configurations.

FIG. 8 illustrates an embodiment of the invention having multiple variations on constructions for the auxiliary conduit, and utilizing an air bleed into the main conduit to enhance fluid flow at large engine loads. Shown at 38A is a construction for the auxiliary conduit having multiple connections to the main conduit 32. At small engine loads, fuel may possibly only enter conduit 38A through the connection to conduit 32 closest to the fuel reservoir. The other connection may flow air only, or possibly some fuel, from conduit 32 at small engine loads. Any air flowed into conduit 38A from any connection to conduuit 32 will contribute to the generation of the auxiliary pressure reduction. As more fuel flows in the carburetor in response to increasing engine load, a point will be reached where the capacity of the connection of conduit 38A to conduit 32 closest to the fuel reservoir will be insufficient for flowing the increased fuel quantity; so fuel will flow into conduit 38A through connections more distant from the fuel reservoir.

Conduit 38B represents an auxiliary conduit flowing only air at small engine loads. Fuel will not enter conduit 38B until the maximum fuel flowing capacity of conduit 38A has been reached, at which point some fuel will flow through conduit 32, past the connections with conduit 38A, and into conduit 38B. Although conduit 38B may flow only air at small engine loads, the air flowed into conduit 38B will contribute to the generation of the auxiliary pressure reduction. Thus, in the construction of FIG. 8, the air flow into both conduits 38A and 38B must be considered when determining the magnitude of the auxiliary pressure reduction. Additionally, if a conventional or supplementary small load fuel supply circuit were to be used instead of conduit 38A as in FIG. 8, conduit 38B could be adjusted to generate an auxiliary pressure reduction to cause fuel to rise in fuel conduit 34 to main conduit 32, and flow fuel from conduit 32 to duct 12 at larger engine loads. Also the connection of conduit 38B to conduit 32 is not necessarily located directly above any part of the fuel reservoir. Since it is possible that no fuel flows into conduit 38B at idle or small loads, the connection of conduit 38B with conduit 32 need not be located above the plane of the fuel level in order for the invention to operate well at small loads.

The construction of FIG. 8 shows an air bleed 62 extending from pressure region A in duct 12 to main conduit 32 near the connection of conduit 38A. The function of air bleed 62 is to supply a metered amount of air to main conduit 32 for enhancing fuel flow in conduit 32 at large load conditions. A particular advantage in the provision of air bleed 62 is that when the carburetor is transitioning from medium to large load conditions, the fluid flowing from conduit 32 into conduits 38A and 38B will consist of a mixture of fuel and air, and there will not be a condition where fuel only is present in either conduits 38A or 38B. It has been found important that the air bleed be connected to conduit 32 at a location not closer to the fuel reservoir than the connection of conduit 38A with conduit 32 that is closest to the reservoir. Otherwise, the air bleed would connect to conduit 32 where there would normally be only liquid fuel at small engine loads. Due to surface tension effects in the liquid fuel, air will not easily or smoothly mix into the liquid fuel under the influence of the small net pressure reduction that exists at small engine loads. The result could possibly be uneven small load fuel flow. For the same reason, it has been found difficult to connect an air bleed to fuel conduit 34. Best results are obtained when the air bleed 62 is connected to main conduit 32 at or just beyond the connection with conduit 38A nearest the fuel reservoir. Also, the fluid flowing capacity of conduits 38A and 38B must be adjusted to compensate for air flow from air bleed 62 into conduit 32, so that the correct auxiliary pressure reduction is determined.

Figure 9:
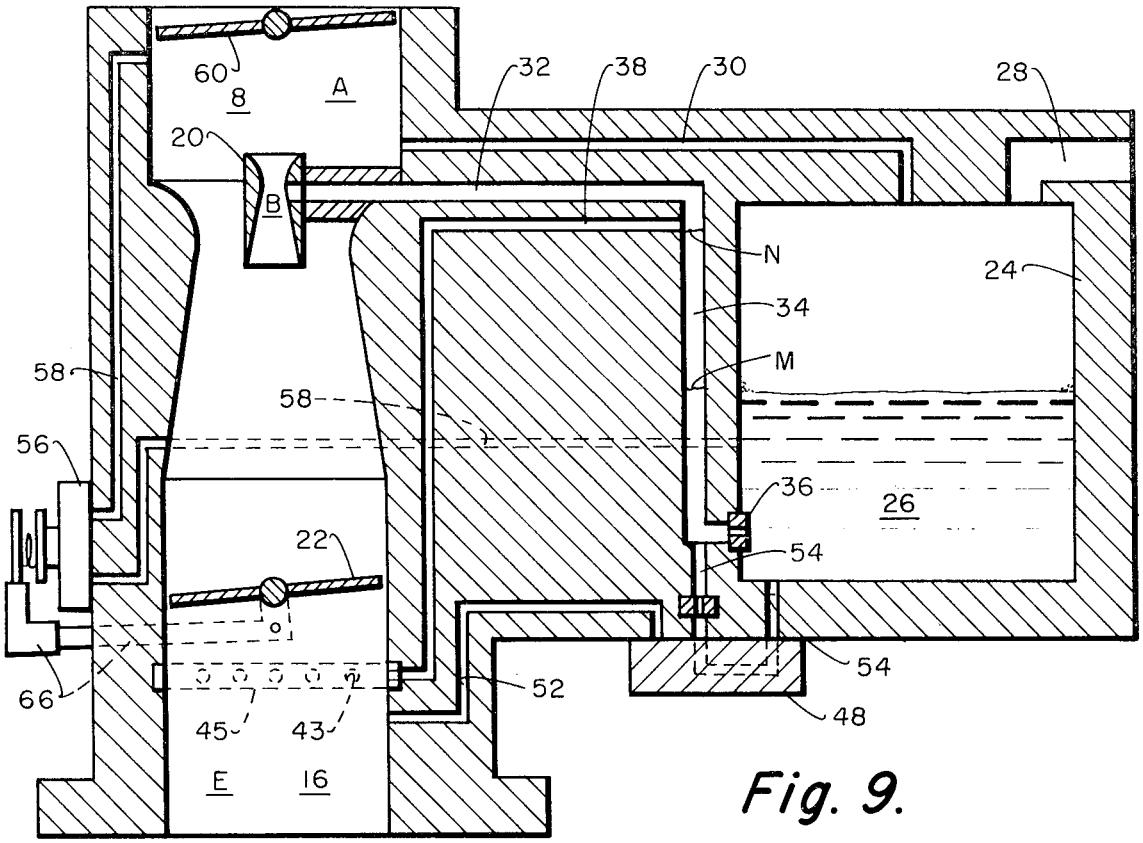
FIG. 9 is a cross-sectional view in semi-schematic form of a carburetor according to the present invention, illustrating the application of several known enhancements from prior carburetor art.

FIG. 9 illustrates the application of some techniques, well known in the art, for enhancing operation of carburetors in general, and which are readily applicable to the present invention. A power valve 48 is sensitive to pressure in region E through passage 52 for allowing fuel to flow through passage 54 to increase fuel flow at large load conditions. An accelerator pump 56 is coupled to the throttle linkage by arm 66 to deliver additional fuel from the fuel reservoir through passage 58 to air inlet 12 upon opening motion of the throttle. A choke valve 60 may be closed to augment the pressure reduction at region B to increase fuel flow for cold engine operation. One or more compound or booster Venturis 20 may be employed to augment the Venturi pressure reduction. An annular channel 45 may be disposed about the periphery of air inlet 12 to deliver fuel from conduit 38 to openings 43, so that fuel discharged into the air intake is distributed evenly into air flowing therethrough. A similar technique may be applied to booster Venturi 20.

FIG. 9 shows a construction of the invention where fuel conduit 34 is located to one side of the fuel reservoir, and the connection of auxiliary conduit 38 to main conduit 32 is not located directly above any part of the fuel reservoir. However, the connection of conduit 38 with conduit 32 is above the plane of the fuel level in the fuel reservoir. Thus, fuel will not drain or siphon out of the fuel reservoir, and the auxiliary pressure reduction must be adjusted to elevate fuel the distance M-N above the fuel level at small engine loads. The invention of FIG. 9 operates in the same manner as constructions having the connection of the main and auxiliary conduits above the fuel reservoir, but is very sensitive to acceleration conditions for the reasons set forth in the description of the conditions which pertained to FIG. 5.

Figure 10:
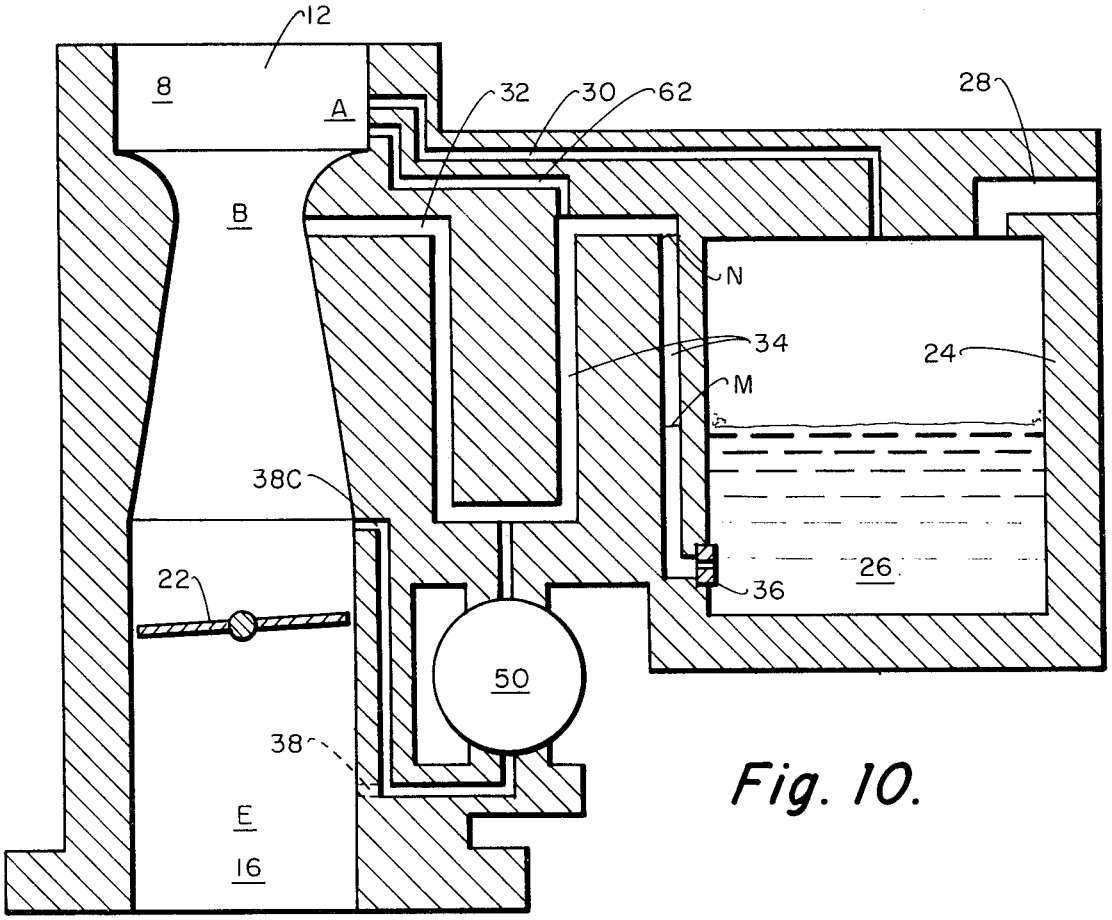
FIG. 10 is a cross-sectional view in semi-schematic form of a carburetor according to the present invention, illustrating an alternate conduit configuration and the addition of a pump to augment fuel flow.

FIG. 10 illustrates additional variations of the present invention. A pump, illustrated schematically at 50, is interposed in auxiliary conduit 38. The pump can sustain fluid flow through conduit 38 under conditions where the pressure in region C approaches the pressure of region B, thus extending the range of flow through conduit 38 into large load engine operating conditions. This also has the effect of diminishing the rate of decrease of the auxiliary pressure reduction with increasing engine load. Thus, the pump 50 supplements or supplants the function of vacuum in the engine intake for flowing fluid through the auxiliary conduit. If desired, and if the pump has sufficient capacity, fuel can be flowed through conduit 38, through the pump 50, and then into the air inlet 12 through conduit 38C upstream of the throttle 22. Since the pump sustains flow through conduit 38 even in the absence of the pressure difference at region C, the auxiliary pressure reduction is generated and affects operation of the invention as previously described.

The construction of FIG. 10 also shows a situation where auxiliary conduit 38 can connect to main conduit 32 at a location that is below the plane of the liquid fuel level in the fuel reservoir. In this construction, fuel conduit 34 extends above the fuel level, reverses, and extends below the plane of the fuel level where it connects to main conduit 32. Air bleed 62 connects to fuel conduit 34 above the plane of the fuel level. In operation, the auxiliary pressure reduction is adjusted so that at small engine loads fuel travels in conduit 34 above the fuel level in the liquid reservoir. Air from air bleed 62 mixes with liquid fuel in conduit 34 and forms an air/fuel emulsion in the downward extending part of conduit 34. Thus, in the upward extending part of conduit 34 there is liquid fuel only, while in the downward extending part of conduit 34, there is a lighter mixture of air and fuel. In this construction, fuel cannot drain out of the fuel reservoir through conduit 34, since it extends above the fuel level, and fuel cannot siphon out of the fuel reservoir through conduit 34 since the weight of fluid in the downward extending part is less than the weight of fluid in the upward extending part. In this case, the air bleed 62 is acting as a siphon breaker for conduit 34. The fuel, however, is still elevated an effective distance M-N by proper setting of the auxiliary pressure reduction at small engine loads. This particular configuration of the conduits 32, 34 and 38 can be used to provide a means for causing a predetermined resistance to fuel flow in response to the net pressure reduction by adjusting any of three aspects of the configuration; the height M-N which fuel conduit 34 rises above the fuel level; the location on the downward extending part of conduit 34 where air bleed 62 is connected; and the distance below the connection of air bleed 62 to conduit 34 where auxiliary conduit 38 connects to main conduit 32.

The advantage in providing an increased resistance to fuel flow is that a larger auxiliary pressure reduction can be employed for proper fuel metering, where the large auxiliary pressure reduction results from increasing the fluid flow through auxiliary conduit 38. Greater fluid flow through conduit 38 extends fuel delivery through conduit 38 towards larger engine load conditions. This may be advantageous for some applications. It will be obvious that many other constructions besides that shown in FIG. 10 can be employed to prevent fuel drainage or siphoning while offering a resistance to fuel flow, and some of these other constructions may not be such that the connection of the auxiliary conduit to the main conduit occurs above the plane of the fuel level in the fuel reservoir.

Whether the auxiliary conduit connects to the main conduit at a location above, at, or below the plane of the fuel level in the reservoir, the air flowed from the main conduit into the auxiliary conduit still causes an auxiliary pressure reduction which sums with the Venturi pressure reduction to meter fuel to the engine. However, construction wherein the connection is located other than above the fuel level require configurations of the various conduits that are somewhat more complex than if the connection is above the fuel level. Since one of the objectives of the present invention is the provision of a simple carburetor, constructions having the connection above the fuel level are preferred.

Also, the pressure reduction required to raise the fuel above the fuel level allows a large flow through the auxiliary conduit to generate the necessary magnitude of the auxiliary pressure reduction. This large flow assures that fuel will be delivered to the air inlet by the auxiliary conduit well into medium engine load conditions. In practice, it has been found that raising the fuel several centimeters above the fuel level gives excellent results.

Figure 11:
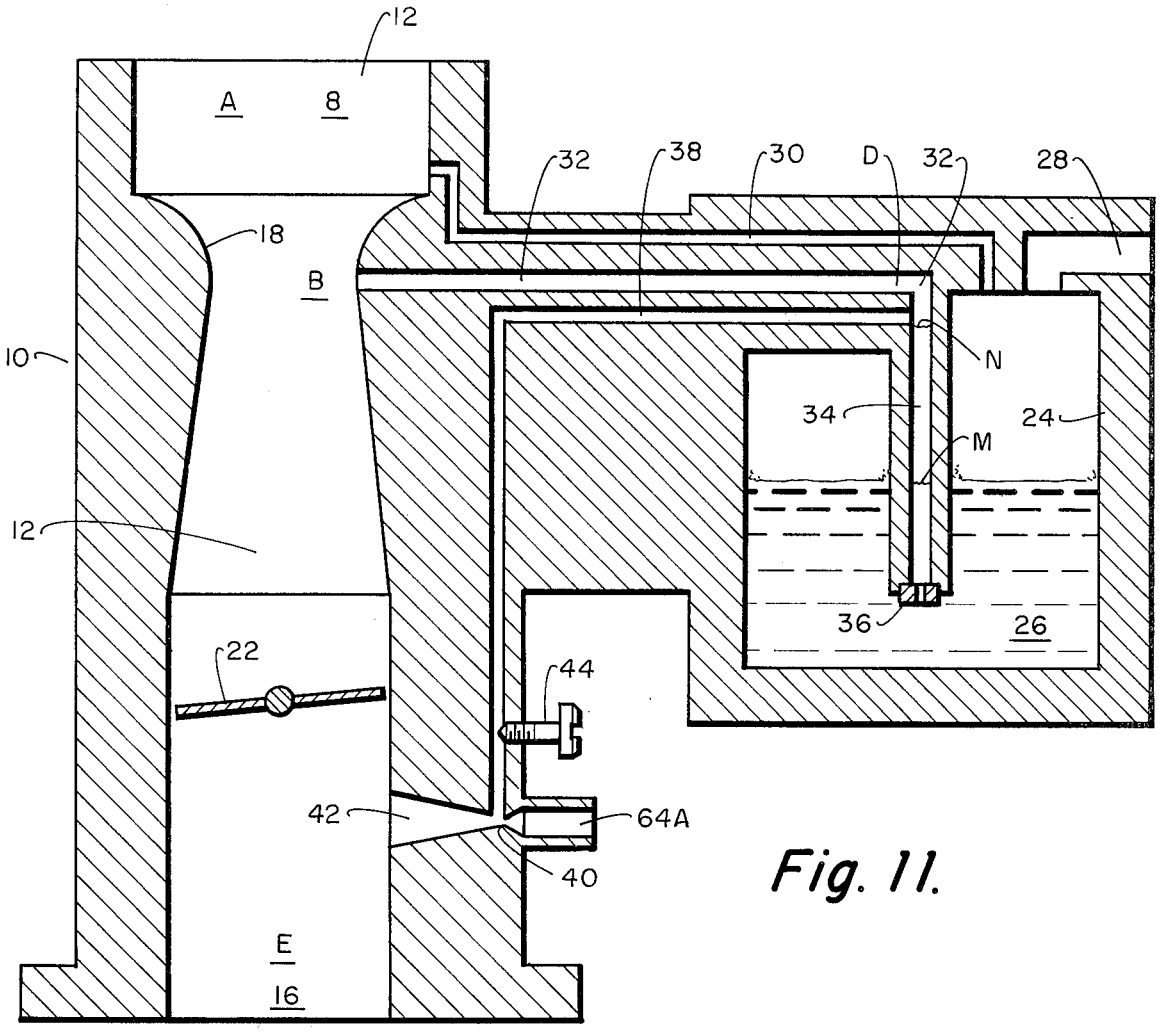
FIG. 11 is a cross-sectional view in semi-schematic form of a carburetor according to the present invention, illustrating fuel vaporization by means of a high speed air nozzle.

FIG. 11 illustrates yet another configuration of the invention, and actually represents a more specific form of the invention as illustrated by FIG. 1. In FIG. 11, the vaporizer, shown at 40, consists of a high speed air nozzle having a Venturi shape as shown. Air, at or near atmospheric pressure, is admitted to vaporizing air nozzle 40 through passageway 64A. The air accelerates through the narrowest constriction of the nozzle and flows into air inlet 12 through fuel vaporizng outlet 42, which has a divergent cross-section, as shown. Auxiliary conduit 38 connects to vaporizer 40 at or near the narrowest point of its Venturi constriction. Since conduit 42 connects to air inlet 12 downstream of throttle 22, the pressure at the narrowest constriction of vaporizer 40 will be approximately at or possibly below the pressure in region E. Thus, the auxiliary pressure reduction will be generated and the invention functions as described for FIG. 1. Fuel is delivered through conduit 38 to vaporizer 40, where the high speed air flow causes liquid fuel droplets to be very finely divided. The resultant extremely small droplets quickly evaporate into the surrounding air, and by this means the function of the vaporizer is achieved. To enhance the process, the fuel flowing through conduit 38 may be heated before being delivered to vaporizing nozzle 40. Also, air flowing into passageway 64A may be preheated. Air flowing into passageway 64A may be flowed from air intake 12 upstream from throttle 22, in a similar manner as air is flowed through conduit 64 in FIG. 7.

Throughout this specification, the present invention has been referred to as belonging to the class of carburetor called fixed venturi, as opposed to the class of carburetor called variable venturi. In the present invention, the walls of the carburetor body which form the air inlet are fixed. This allows the generation of a proportional venturi signal which varies according to the quantity of air flow through the intake, whereby a proportional amount of fuel is drawn from the fuel reservoir. Therefore, what is meant herein by an air intake of "fixed configuration" is an air intake defined in a carburetor body by walls which are fixed and do not move over various operating conditions.

It should be noted that the preferred embodiments of the invention are described herein in terms of their application to the most currently common type of internal combustion engine. In order to relate operation of the invention to more universal application, the following are defined. Idle engine load is when the throttle valve is closed or nearly closed, the airflow through the air inlet is small, and the absolute pressure in the air inlet downstream from the throttle is much less than upstream. Small engine load is when the throttle is open slightly more than at idle, airflow through the air intake is small, but more than at idle, and there is a large pressure drop across the throttle where the pressure downstream from the throttle is much less than upstream. Large engine load is when the throttle is open a large amount, but slightly less than fully open, the airflow through the air intake is greater than at idle, and the pressure difference in the air intake across the throttle is small. Maximum engine load is where the throttle is fully open, there is a large airflow through the air intake, and the pressure difference in the air intake across the throttle is very small or zero.

It will be understood that there are many other ways of practicing what is taught by the present invention besides what is specifically shown in the figures. For instance, a single carburetor unit according to the present invention could be constructed having several air intake passageways, fuel conduits, main conduits, and auxiliary conduits, but sharing a common fuel reservoir. This would be analogous to the multi-Venturi carburetors well known in the conventional carburetor art. Also, any constant pressure fuel supply system could be used as fuel reservoir 26 to supply fuel to fuel conduit 34, as long as fuel pressure is not so high as to force fuel into main conduit 32 in the absence of any net pressure reduction.

In view of the above teachings, it is to be understood that many changes and modifications are possible within the spirit of the present invention, and that the full scope of the invention is not limited to the specific details disclosed herein, but may be practiced otherwise as defined in the claims appended hereto.

What is claimed is:

1. A carburetion system for an internal combustion engine comprising:

air inlet means of fixed configuration having upstream and downstream ends;

a fuel reservoir adapted to contain an essentially constant level of fuel therein;

first passageway means of predetermined fluid flowing capacity, for flowing air out of said air inlet means and fuel into said air inlet means, extending between said air inlet means proximate the upstream end thereof and said fuel reservoir below the level of fuel therein;

throttle valve means disposed in said air inlet means downstream from said first conduit means;

second passageway means of predetermined fluid flowing capacity for flowing air and fuel from said first passageway means to said air inlet means at a location downstream from said throttle valve means;

said second passageway means connected to said first passageway means at a location such that air flows from said air inlet means through said first passageway means into said second passageway means when the engine is at idle load conditions;

air flow from said first passageway means into said second passageway means causing a pressure reduction of predetermined magnitude in said first passageway means;

said predetermined fluid flowing capacity of said first passageway means being specifically proportioned to said predetermined fluid flowing capacity of said second passageway means so as to determine said magnitude of said pressure reduction; and said magnitude being determined such that an essentially correct amount of fuel is metered to the engine for engine operation at all speeds and loads.

2. The carburetion system according to claim 1 including:

fuel vaporizing means for vaporizing liquid fuel flowing through said second passageway means.

3. A carburetion system according to claim 1 wherein said second passageway means is connected to said first passageway means at a location which is at a distance, spaced from the air inlet, equal to at least one-half the perimeter of said first passageway means at the connection to said second passageway means.

4. A carburetion system according to claim 1 wherein adjustable valve means is provided in said second passageway means for adjusting said predetermined fluid flowing capacity of said second passageway means.

5. A carburetion system according to claim 1 wherein the majority of said fuel delivered to said air inlet is delivered by said second passageway means at small engine loads and by said first passageway means at large engine loads.

6. A carburetion system according to claim 1 wherein said first and second passageway means constitute the only passageway means for flow of fuel from said reservoir to said air inlet means.

7. A carburetion system according to claim 1 wherein only air is flowed through said second passageway means at engine idle load conditions.

8. A carburetion system according to claim 1 wherein the fuel is flowed through said second passageway means at engine idle load conditions.

9. A carburetion system according to claim 1 wherein the majority of engine idle load fuel is delivered to said air inlet means by said second passageway means.

10. A carburetion system according to claim 1 wherein all engine idle load fuel is delivered to said air inlet means by said second passageway means.

11. A carburetion system according to claim 1 wherein said predetermined fluid flowing capacity of said first passageway means is at least sufficient to allow flow of essentially all fuel required for engine operation at maximum engine load conditions.

12. The carburetion system according to claim 1 wherein a venturi pressure reduction is generated in said air inlet and applied to said first passageway means.

13. A carburetion system according to claim 1 wherein said magnitude of said auxiliary pressure reduction is determined such that at engine idle load condition fuel rises in said first passageway means above the plane of the fuel level in the reservoir to essentially the location of the connection of said second passageway means to said first passageway means.

14. A carburetion system according to claim 1 wherein said magnitude of said auxiliary pressure reduction is determined such that the correct amount of fuel for engine idling flows from said reservoir into said first passageway means at idle load conditions.

15. A carburetion system according to claim 1 wherein said connection of said second passageway means to said first passageway means is at a location that is essentially centered above the fuel in the fuel reservoir.

16. A carburetion system for an internal combustion engine comprising:

an air inlet into the engine, said air inlet being of fixed configuration and having upstream and downstream ends;

a fuel reservoir adapted to contain a level of liquid fuel therein;

main conduit means of predetermined fluid flowing capacity;

said main conduit means intersecting said air inlet proximate said upstream end such that a pressure reduction proportional to the quantity of air flowing through said air inlet is applied to said main conduit means;

throttle valve means disposed in said air inlet downstream from said intersection;

fuel conduit means connecting said main conduit means to liquid fuel in said reservoir;

auxiliary conduit means of predetermined fluid flowing capacity connected to said main conduit means and connected to said air inlet downstream from said throttle valve means;

the connection of said auxiliary conduit means to said main conduit means located above the plane of the liquid fuel level in said reservoir when the engine is operating at idle load condition such that air from said air inlet is flowed through said main conduit means into said auxiliary conduit means to cause an auxiliary pressure reduction of predetermined magnitude to be generated in said main conduit means;

said predetermined fluid flowing capacity of said auxiliary conduit means specifically proportioned to said predetermined fluid flowing capacity of said main conduit means such that the quantity of air flowed into said auxiliary conduit means from said main conduit means determines said magnitude of said auxiliary pressure reduction;

said auxiliary pressure reduction being such that an essentially correct amount of fuel is metered to said engine at all speeds and loads;

said pressure reduction and auxiliary pressure reduction functioning cooperatively in acting on said fuel conduit means to cause fuel to flow from said fuel reservoir into said fuel conduit means;

whereby fuel is metered from said fuel conduit means into said main and auxiliary conduit means to be delivered to said air inlet.

17. A carburetion system for an internal combustion engine comprising:

an air inlet into the engine, said air inlet being of fixed configuration and having upstream and downstream ends;

a fuel reservoir adapted to contain a level of liquid fuel therein;

main conduit means of predetermined fluid flowing capacity;

said main conduit means intersecting said air inlet proximate said upstream end such that a pressure reduction proportional to the quantity of air flowing through said air inlet is applied to said main conduit means;

throttle valve means disposed in said air inlet downstream from said intersection;

fuel conduit means connecting said main conduit means to liquid fuel in said reservoir;

auxiliary conduit means of predetermined fluid flowing capacity connected to said main conduit means and connected to said air inlet downstream from said throttle valve means;

the connection of said auxiliary conduit means to said main conduit means located between said intersection and any operating level of essentially liquid fuel in said main and fuel conduit means when the engine is operating at idle load condition such that air from said air inlet is flowed through said main conduit means into said auxiliary conduit means to cause an auxiliary pressure reduction of predetermined magnitude to be generated in said main conduit means;

said predetermined fluid flowing capacity of said auxiliary conduit means specifically proportioned to said predetermined fluid flowing capacity of said main conduit means such that the quantity of air flowed into said auxiliary conduit means from said main conduit means determines said magnitude of said auxiliary pressure reduction;

said auxiliary pressure reduction being such that an essentially correct amount of fuel is metered to said engine at all speeds and loads;

said pressure reduction and auxiliary pressure reduction functioning cooperatively in acting on said fuel conduit means to cause fuel to flow from said fuel reservoir into said fuel conduit means;

whereby fuel is metered from said fuel conduit means into said main and auxiliary conduit means to be delivered to said air inlet.

18. A carburetion system for an internal combustion engine comprising:

air inlet conduit means of fixed configuration supplying air to said engine;

venturi means disposed in said air inlet conduit means for generating a pressure reduction proportional to the amount of air flowing therethrough;

throttle valve means disposed in said air inlet conduit means downstream from said venturi means;

liquid fuel reservoir means;

main conduit means of predetermined fluid flowing capacity in communicative connection with said air inlet conduit means proximate said venturi means such that said pressure reduction is applied to said main conduit means;

fuel conduit means connecting said main conduit means to said liquid fuel reservoir means for transporting liquid fuel from said reservoir to said main conduit means;

auxiliary conduit means of predetermined fluid flowing capacity connecting said main conduit means to said air inlet conduit means at a location downstream of said throttle valve means;

said connection of said auxiliary conduit means to said main conduit means located between said connection of said main conduit means with said air inlet conduit means and any operating level of essentially entirely liquid fuel in said fuel conduit and main conduit means when said engine is operating at idle load condition such that air from said air inlet conduit means is flowed through said main conduit means into said auxiliary conduit means to cause an auxiliary pressure reduction of predetermined magnitude to be generated in said main conduit means;

said predetermined fluid flowing capacity of said auxiliary conduit means being specifically proportioned to said predetermined fluid flowing capacity of said main conduit means such that the quantity of air flowed into said auxiliary conduit means from said main conduit means determines said magnitude of said auxiliary pressure reduction;

said auxiliary pressure reduction being such that an essentially correct amount of fuel is metered to said engine at all speeds and loads;

said pressure reduction and auxiliary pressure reduction functioning cooperatively in acting on said fuel conduit means to cause fuel to flow from said reservoir into said fuel conduit means;

whereby fuel is delivered from said fuel reservoir to said air inlet conduit means.

19. A carburetion system for an internal combustion engine comprising:

air inlet conduit means of fixed configuration supplying air to said engine;

venturi means disposed in said air inlet conduit means for generating a pressure reduction proportional to the amount of air flowing therethrough;

throttle valve means disposed in said air inlet conduit means downstream from said venturi means;

liquid fuel reservoir means;

main conduit means of predetermined fluid flowing capacity in communicative connection with said air inlet conduit means proximate said venturi means such that said pressure reduction is applied to said main conduit means;

fuel conduit means connecting said main conduit means to said liquid fuel reservoir means for transporting liquid fuel from said reservoir to said main conduit means;

fuel vaporizing means for vaporizing liquid fuel;

fuel vaporizing inlet conduit means of predetermined fluid flowing capacity connecting said main conduit means to said vaporizing means;

said connection of said fuel vaporizing inlet conduit means to said main conduit means located between said connection of said main conduit means with said air inlet conduit means and any operating level of essentially entirely liquid fuel in said fuel conduit and main conduit means when said engine is operating at idle load condition such that air from said air inlet conduit means is flowed through said main conduit means into said fuel vaporizing inlet conduit means to cause an auxiliary pressure reduction of predetermined magnitude to be generated in said main conduit means;

said predetermined fluid flowing capacity of said fuel vaporizing inlet conduit means being specifically proportioned to said predetermined fluid flowing capacity of said main conduit means such that the quantity of air flowed into said fuel vaporizing inlet conduit means from said main conduit means determines said magnitude of said auxiliary pressure reduction;

said auxiliary pressure reduction being such that an essentially correct amount of fuel is metered to said engine at all speeds and loads;

said pressure reduction and auxiliary pressure reduction functioning cooperatively in acting on said fuel conduit means to cause fuel to flow from said reservoir into said fuel conduit means; and fuel vaporizing outlet conduit means connecting said fuel vaporizing means to said air inlet conduit means at a location downstream of said throttle valve means;

whereby fuel is delivered from said fuel reservoir to said air inlet conduit means.

20. A carburetion system according to claim 16 or 17 or 18 including fuel vaporizing means interposed in said auxiliary conduit means for vaporizing fuel flowing through said auxiliary conduit means.

21. A carburetion system according to claims 16 or 17 wherein said connection of said auxiliary conduit means to said main conduit means is located at least a minimum distance from said intersection of said main conduit means with said air inlet, said minimum distance being equal to the perimeter of said main conduit means at said intersection with said air inlet.

22. A carburetion system according to claims 16 or 17 or 18 wherein adjustable valve means is provided in said auxiliary conduit means for adjusting said predetermined fluid flowing capacity of said auxiliary conduit means.

23. A carburetion system according to claims 16 or 17 or 18 wherein fuel is flowed through said auxiliary conduit means at engine idle load conditions.

24. A carburetion system according to claims 16, 17, 18 or 19 wherein said fuel conduit means has a predetermined fluid flowing capacity such that the correct amount of fuel for engine operation at all speeds and loads flows through said fuel conduit means in response to said cooperative action of said pressure reduction and auxiliary pressure reductions.

25. A carburetion system according to claims 16 or 17 or 18 wherein said connection of said auxiliary conduit means to said main conduit means is at a location that is essentially centered above the fuel in the fuel reservoir.

26. A carburetion system according to claims 16 or 17 or 18 wherein the majority of said fuel delivered to said air inlet is delivered by said auxiliary conduit means at small engine loads and by said main conduit means at large engine loads.

27. A carburetion system according to claims 16 or 17 or 18 wherein said magnitude of said auxiliary pressure reduction is determined such that at engine idle load condition fuel rises in said fuel conduit means above the plane of the fuel level in the reservoir to essentially the location of the connection of said auxiliary conduit means to said main conduit means.

28. A method for metering fuel to an internal combustion engine in a fuel system having:

an air inlet of fixed configuration into the engine;

a fuel reservoir;

throttle valve means disposed in said air inlet; and first passageway means of predetermined fluid flowing capacity connected to said air inlet upstream from said throttle valve means and connected to fuel in said fuel reservoir, said method comprising:

flowing air from said first conduit means to said air inlet downstream from said throttle valve means through second passageway means of predetermined fluid flowing capacity;

generating a pressure reduction of predetermined magnitude in said first passageway means, said pressure reduction resulting from the air flowing out of said first passageway means into said second passageway means;

flowing air from said air inlet into said first passageway means to replace air flowed out of said first passageway means into said second passageway means;

specifically proportioning said predetermined fluid flowing capacity of said second passageway means to said predetermined fluid flowing capacity of said first passageway means such that said magnitude of said pressure reduction is determined; and determining said magnitude such that an essentially correct amount of fuel is delivered from said reservoir to said engine at all speed and load conditions.

29. A method according to claim 28 including the step of vaporizing liquid fuel flowing through said second passageway means by means of a vaporizer interposed in said second passageway means.

30. A method according to claim 28 wherein said predetermined fluid flowing capacity of said second passageway means is adjustable.

31. A method according to claim 28 wherein only air flows through said second passageway means at engine idle load conditions.

32. A method according to claim 28 wherein the majority of fuel delivered to said air inlet is delivered by said second passageway means at small engine loads and by said first passageway means at large engine loads.

33. A method according to claim 28 where essentially all engine idle load fuel flows through said second passageway means.

34. A method according to claim 28 including the step of generating a venturi pressure reduction in said air inlet proportional to the amount of air flowing therethrough, and applying said venturi pressure reduction to said first passageway means.

35. The carburetion system according to claim 20 wherein said vaporizing means is a heater adapted to provide heat sufficient for fuel vaporization.

* * * * *